US012129653B2

(12) United States Patent
Kang et al.

(10) Patent No.: US 12,129,653 B2
(45) Date of Patent: Oct. 29, 2024

(54) VARIABLE ASSEMBLY PC MEMBER

(71) Applicants: Seoul National University R&DB Foundation, Seoul (KR); EURO ENGINEERING CO., LTD., Seoul (KR)

(72) Inventors: Thomas Hyun Koo Kang, Seoul (KR); Keun Sam Kim, Seoul (KR)

(73) Assignees: Seoul National University R&DB Foundation, Seoul (KR); EURO ENGINEERING CO., LTD., Seoul (KR)

( * ) Notice: Subject to any disclaimer, the term of this patent is extended or adjusted under 35 U.S.C. 154(b) by 163 days.

(21) Appl. No.: 17/880,600

(22) Filed: Aug. 3, 2022

(65) Prior Publication Data

US 2023/0003024 A1 Jan. 5, 2023

Related U.S. Application Data

(63) Continuation-in-part of application No. PCT/KR2021/002374, filed on Feb. 25, 2021, and a (Continued)

(30) Foreign Application Priority Data

Feb. 6, 2020 (KR) ..... 10-2020-0014280
May 7, 2020 (KR) ..... 10-2020-0054598

(51) Int. Cl.
*E04C 5/065* (2006.01)
*E04B 1/21* (2006.01)
*E04C 5/16* (2006.01)

(52) U.S. Cl.
CPC ..... *E04C 5/0653* (2013.01); *E04B 1/215* (2013.01); *E04C 5/163* (2013.01)

(58) Field of Classification Search
CPC ..... E04B 1/215; E04B 1/6133; E04B 1/6183; E04B 2001/3583; E04C 5/0653; E04C 5/163; E04C 5/165
See application file for complete search history.

(56) References Cited

U.S. PATENT DOCUMENTS 3,369,334 A * 2/1968 Berg ..... E04B 1/06 52/223.13
3,869,530 A * 3/1975 Williams ..... E04G 21/12 52/223.3

(Continued)

FOREIGN PATENT DOCUMENTS

CN 101004070 A 7/2007
CN 106555453 A 4/2017

(Continued)

OTHER PUBLICATIONS

Office Action of Korean Patent Application No. 10-2020-0014280 mailed Mar. 24, 2021.

(Continued)

*Primary Examiner* — Christine T Cajilig
(74) *Attorney, Agent, or Firm* — Revolution IP, PLLC

(57) ABSTRACT

A variable assembly PC member includes: a plurality of hollow PC modules, each of which has an upper flange and a lower flange spaced apart from each other, and a pair of webs connecting both ends of the upper flange and the lower flange to form a hollow therein; and connectors connecting the plurality of hollow PC modules with each other in the width direction.

9 Claims, 31 Drawing Sheets

Related U.S. Application Data continuation-in-part of application No. PCT/KR2021/001146, filed on Jan. 28, 2021.

(56) References Cited

U.S. PATENT DOCUMENTS

| | | | | |
|---|---|---|---|---|
| 3,952,468 | A * | 4/1976 | Soum | E04C 5/165 52/223.13 |
| 4,099,360 | A * | 7/1978 | Outram | E04B 1/21 52/745.18 |
| 6,065,263 | A * | 5/2000 | Taguchi | F16B 7/06 52/583.1 |
| 2002/0014050 | A1* | 2/2002 | Van Der Heijden | E04B 2/08 52/223.7 |
| 2007/0017176 | A1* | 1/2007 | Gray | E04C 5/165 52/605 |

FOREIGN PATENT DOCUMENTS

| | | | |
|---|---|---|---|
| JP | 2000-320023 | A | 11/2000 |
| JP | 2011-026868 | A | 2/2011 |
| KR | 10-0681849 | B1 | 2/2007 |
| KR | 20-2008-0004835 | U | 10/2008 |
| KR | 10-2016-0030695 | A | 3/2016 |
| KR | 10-1713632 | B1 | 3/2017 |
| KR | 10-1776129 | B1 | 9/2017 |
| KR | 10-2020-0027621 | A | 3/2020 |

OTHER PUBLICATIONS

Office Action of Korean Patent Application No. 10-2020-0054598 mailed Jul. 14, 2020.

* cited by examiner

【FIG 1】
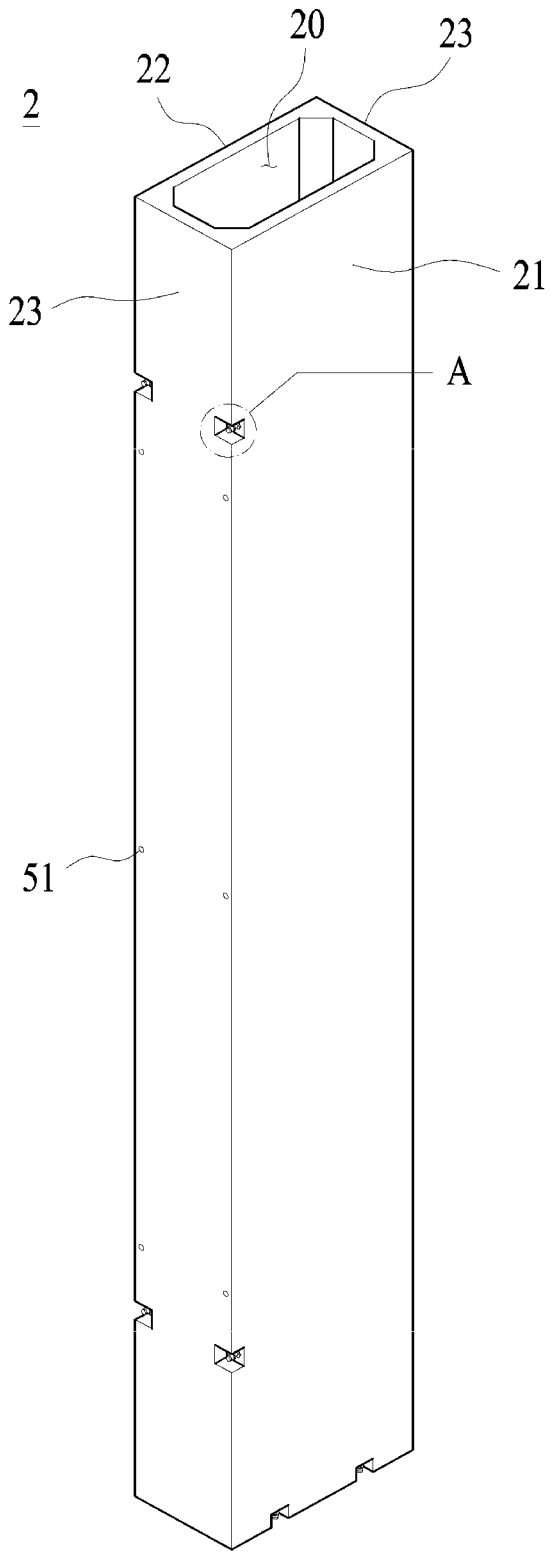

【FIG 2】
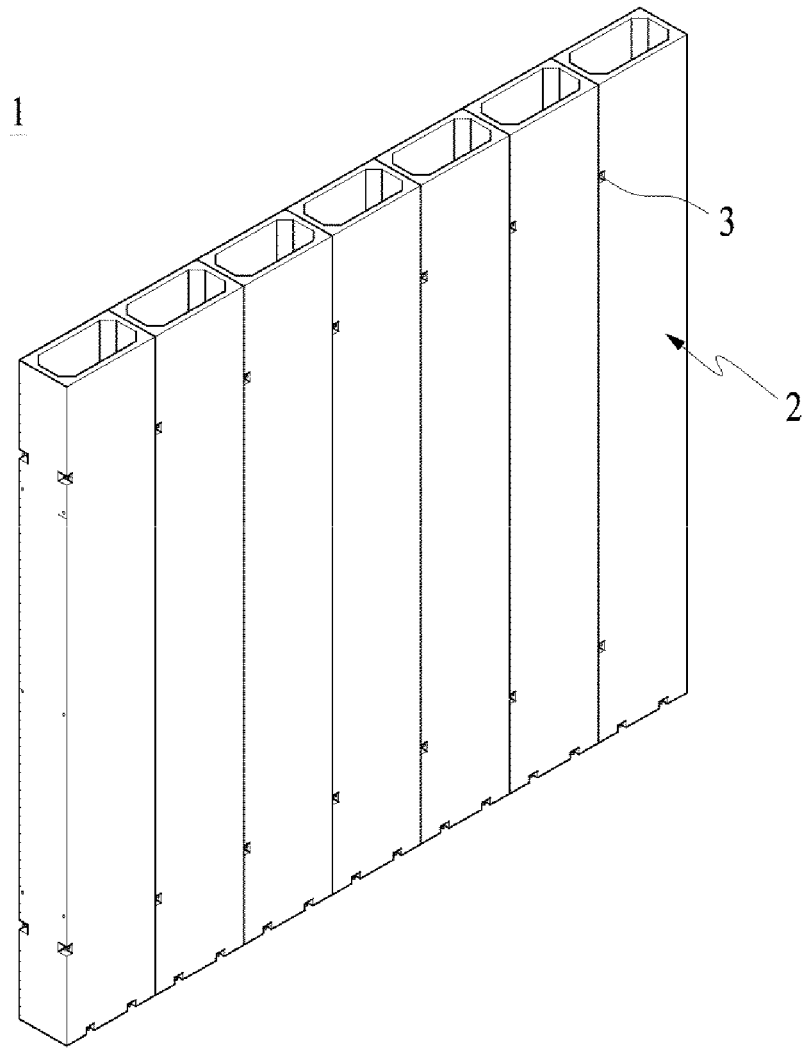

【FIG 3】
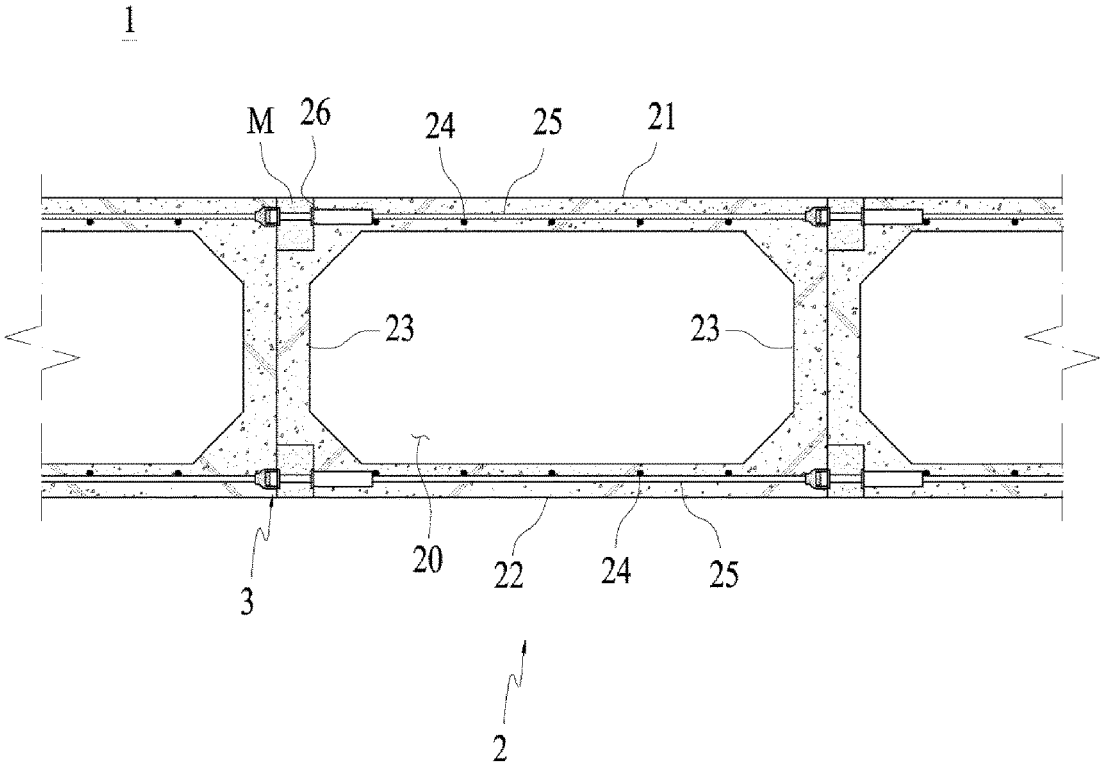

【FIG 4】
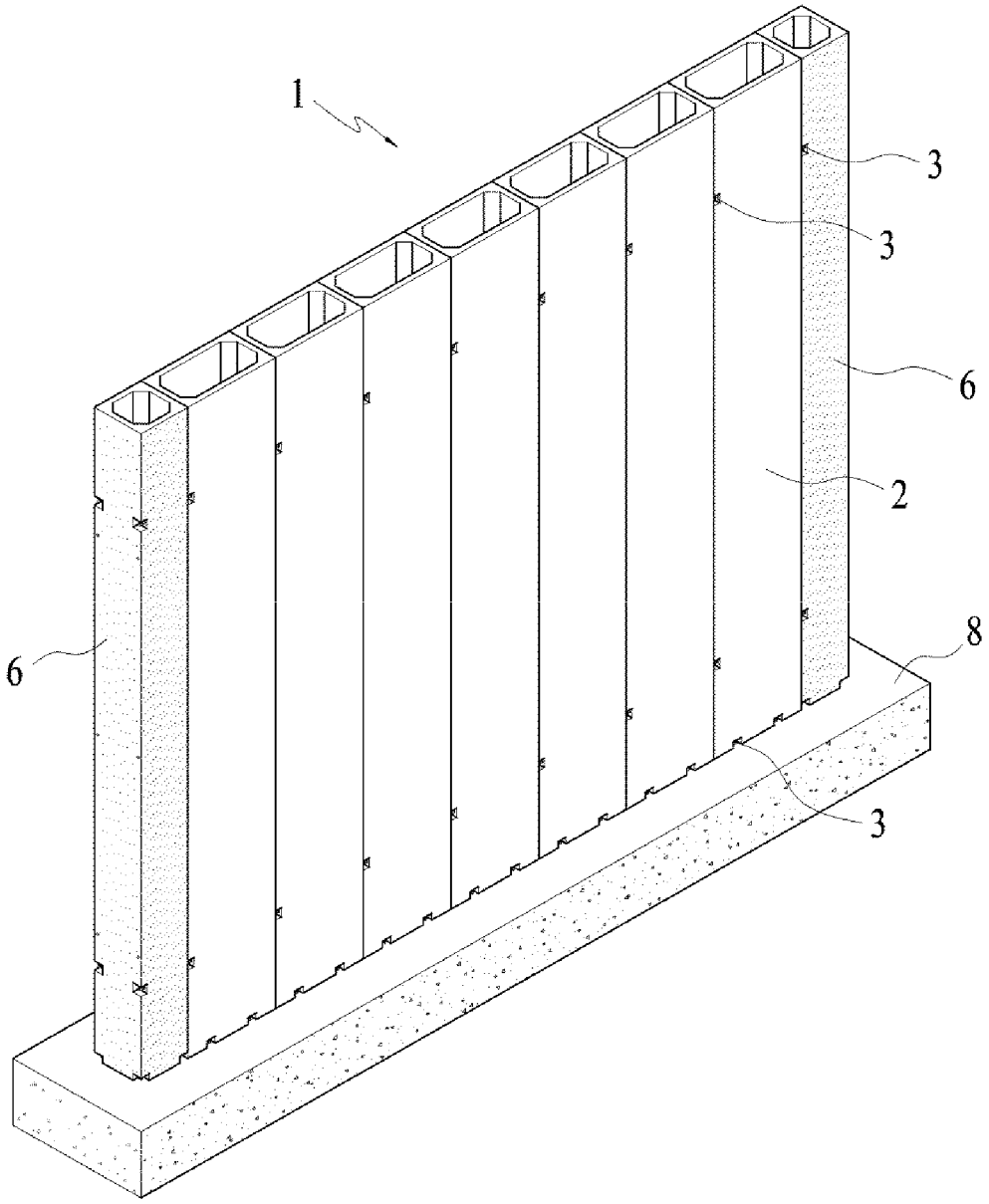

【FIG 5】
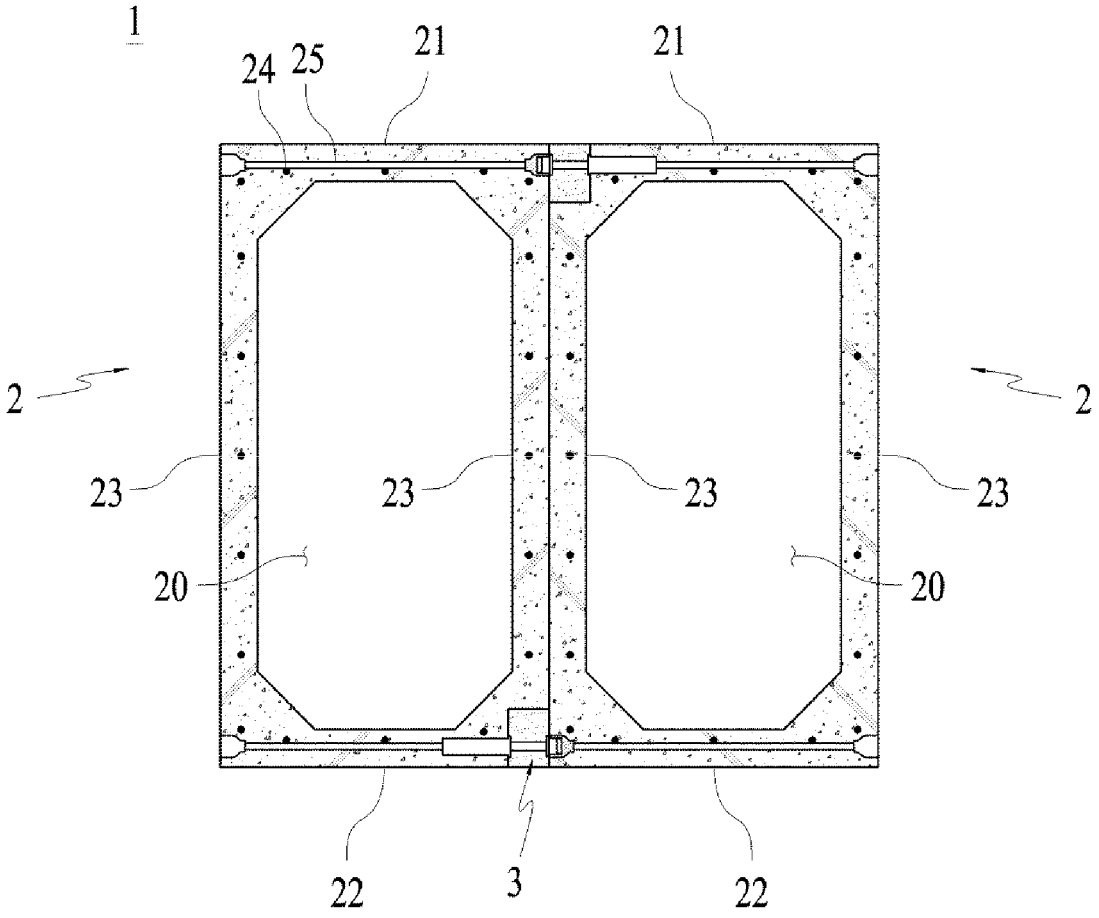

【FIG 6】
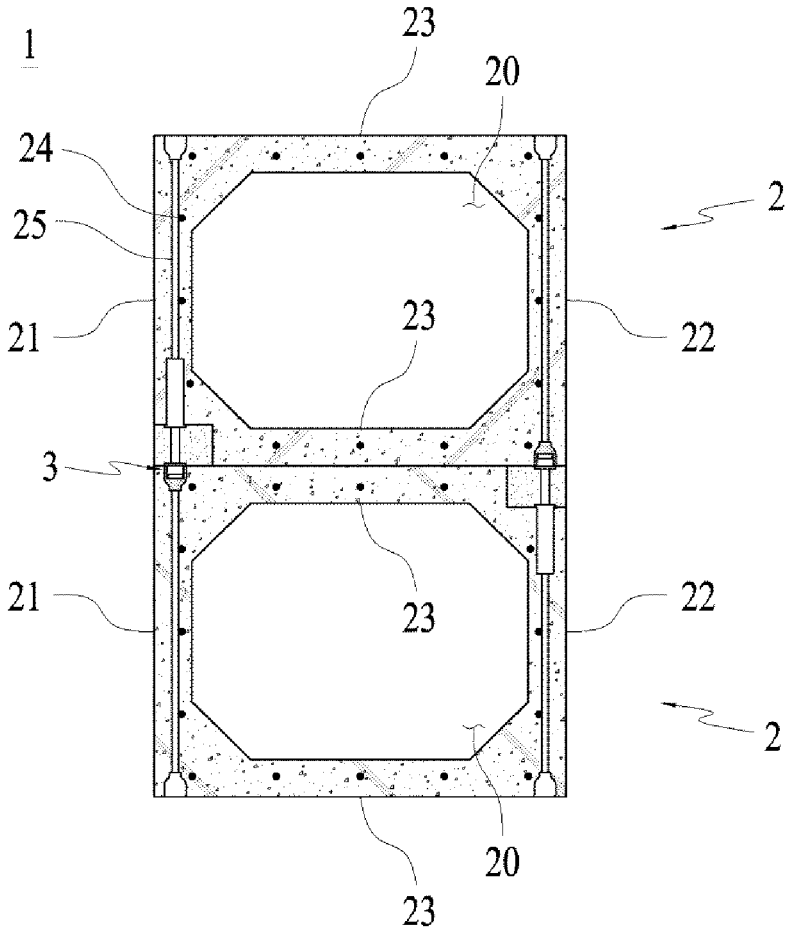

【FIG 7】
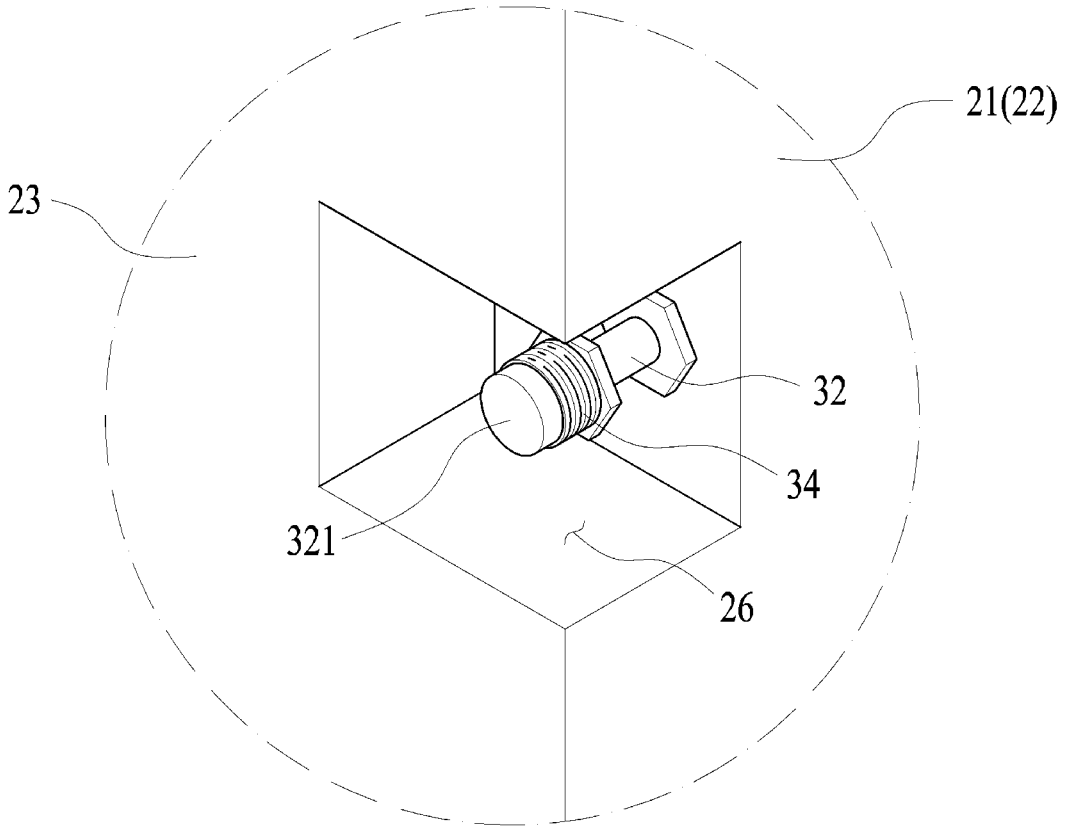

【FIG 8】
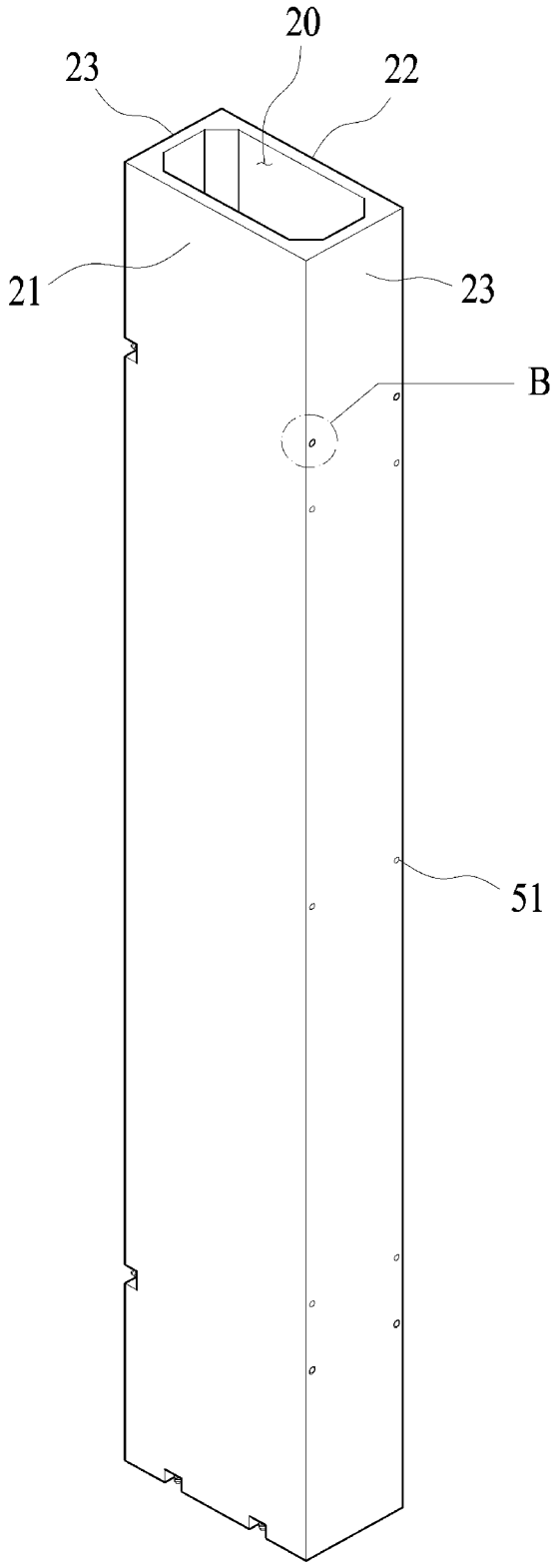

【FIG 9】
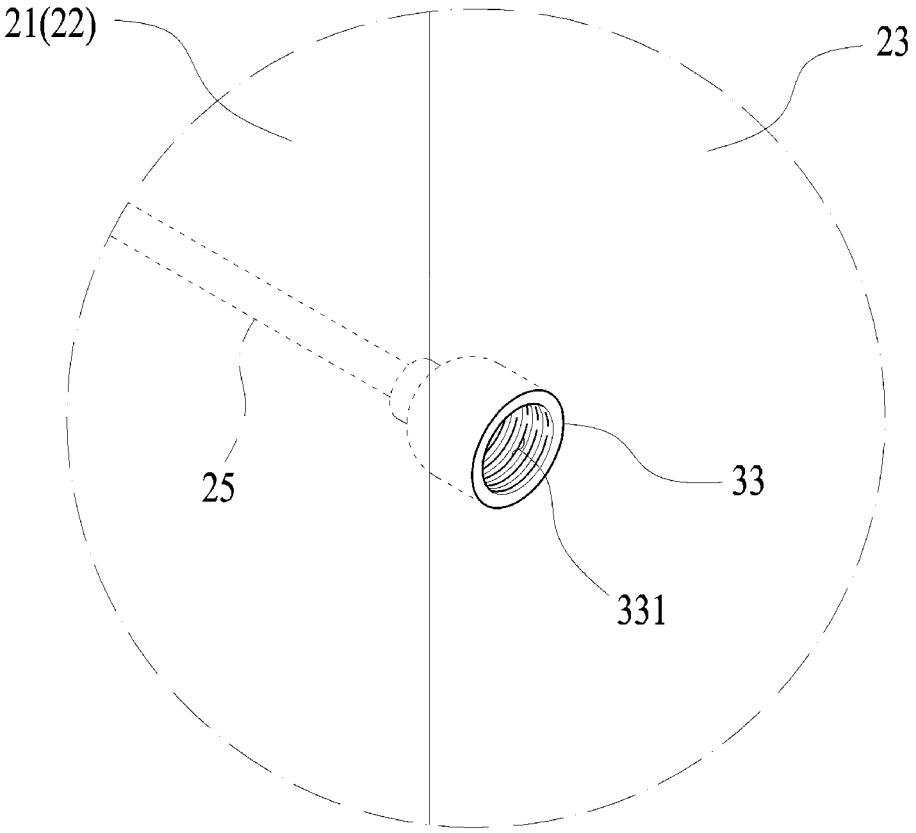

【FIG 10a】
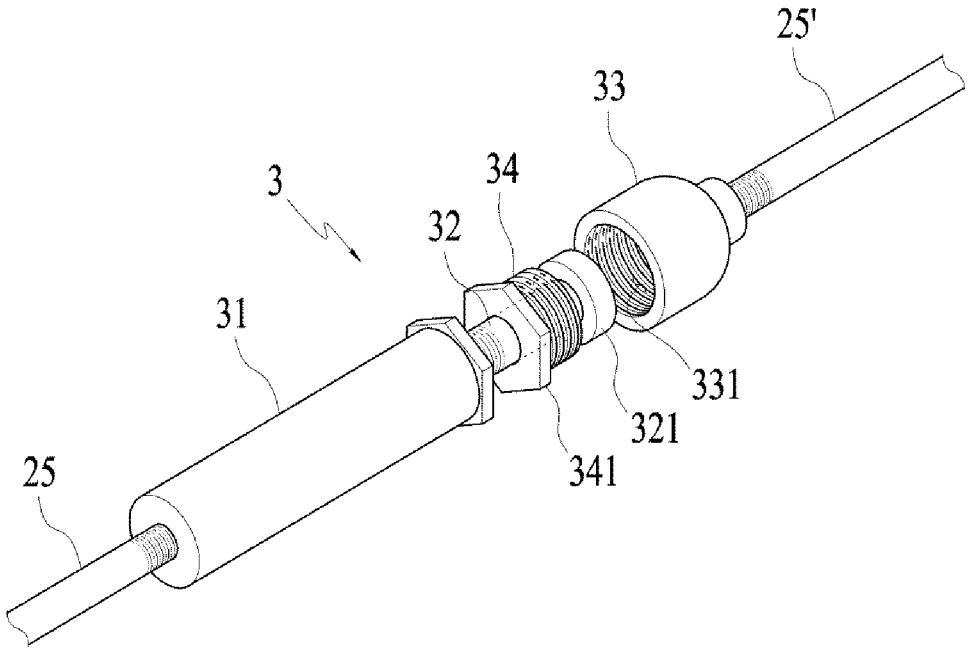
【FIG 10b】
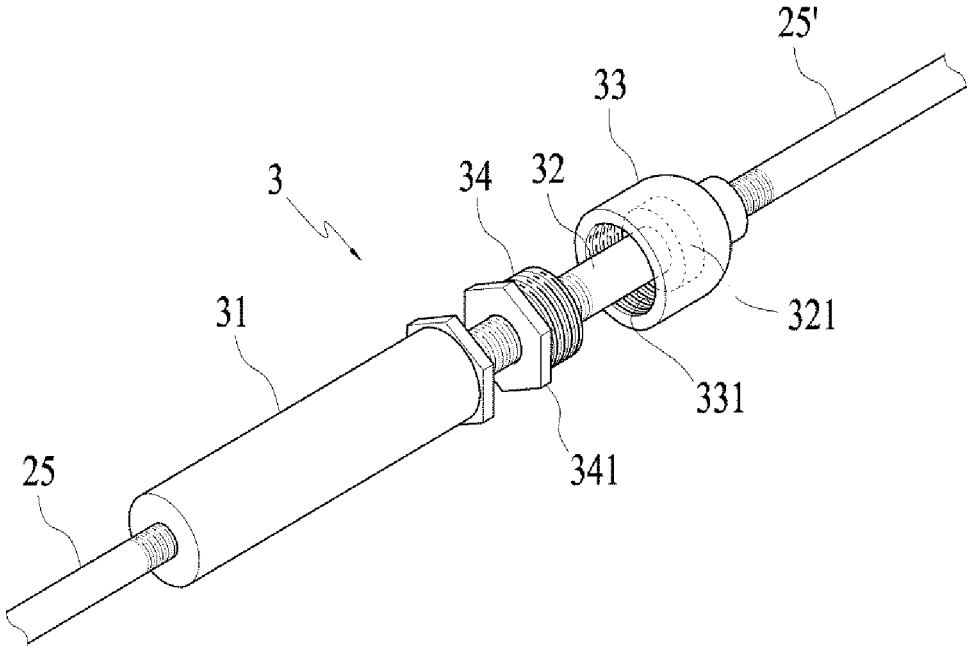

【FIG 10c】
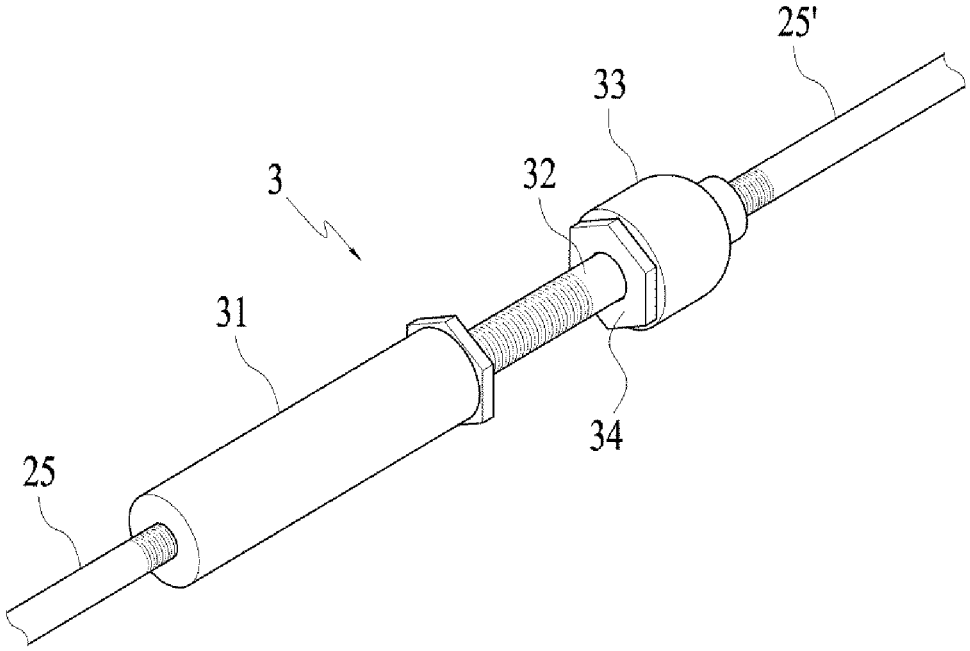

【FIG 11a】
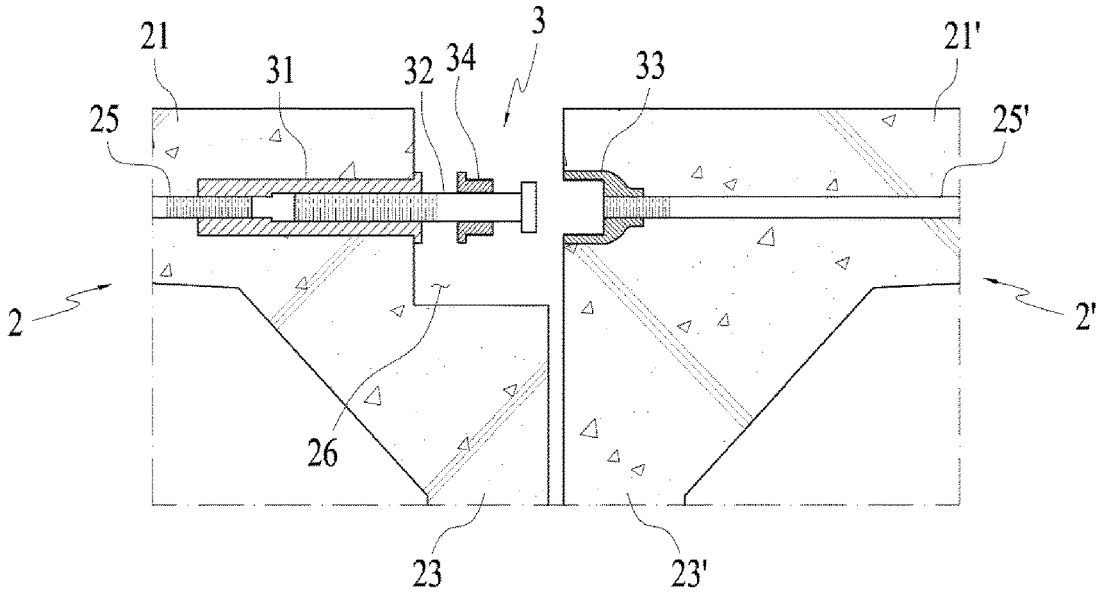
【FIG 11b】
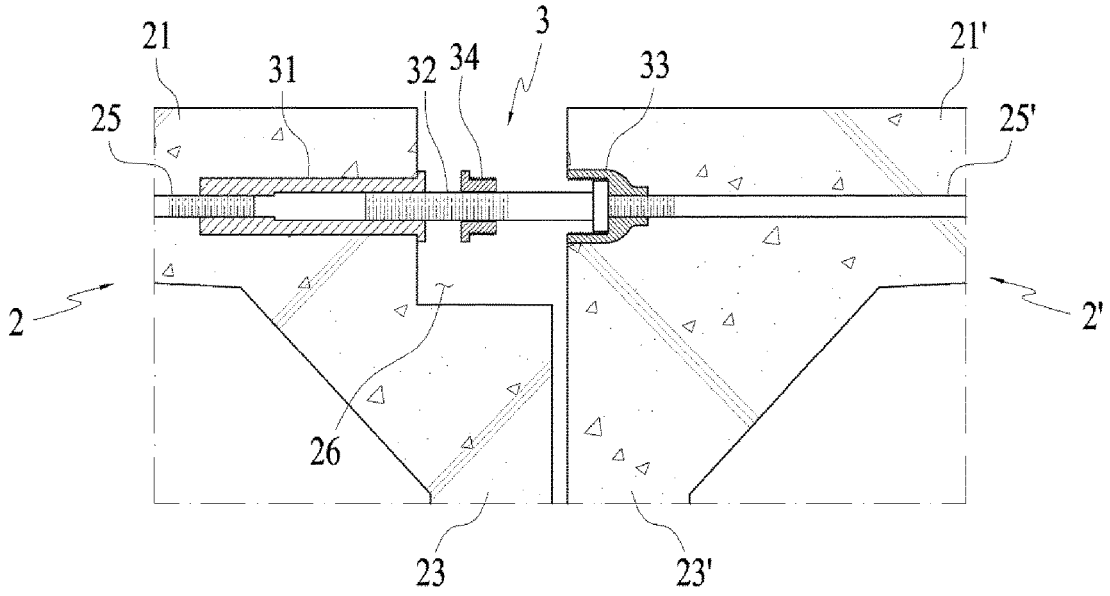

【FIG 11c】
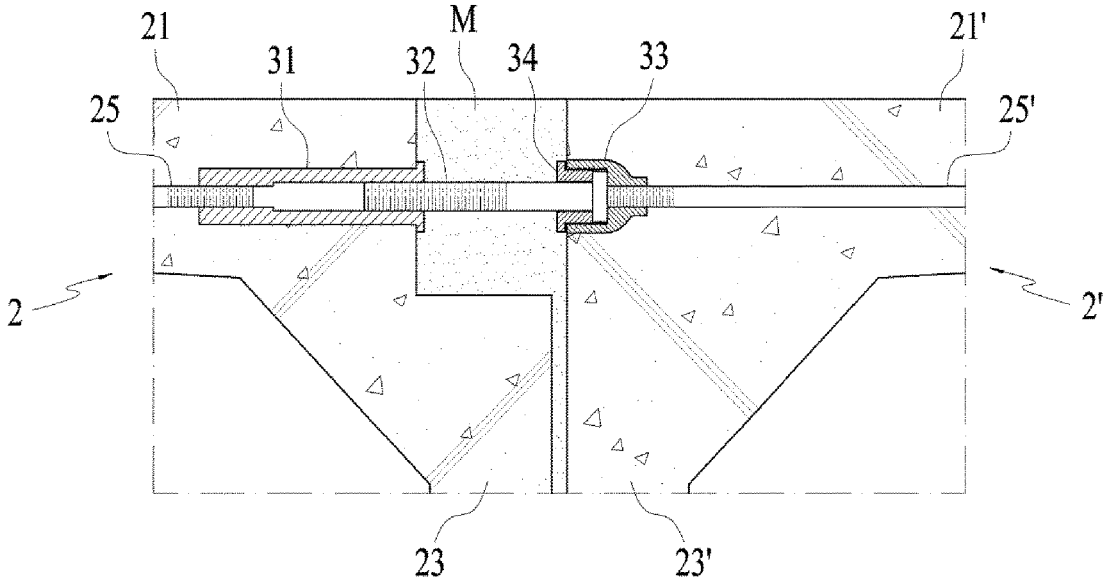

【FIG 12a】
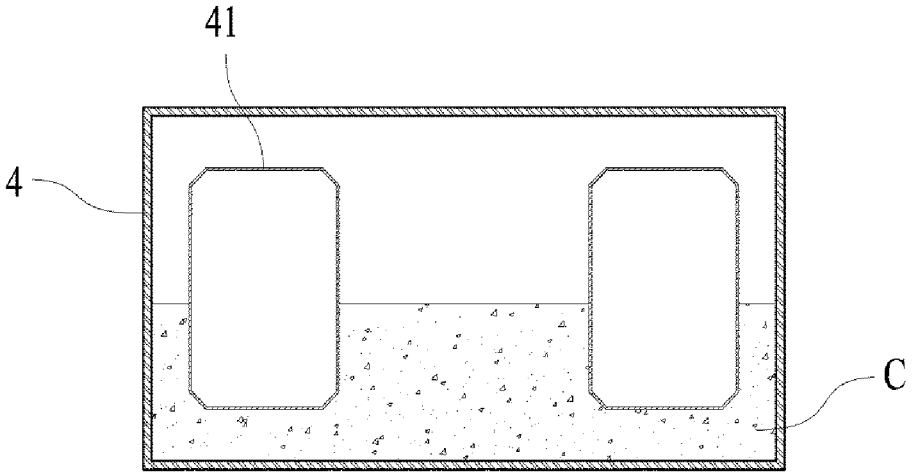
【FIG 12b】
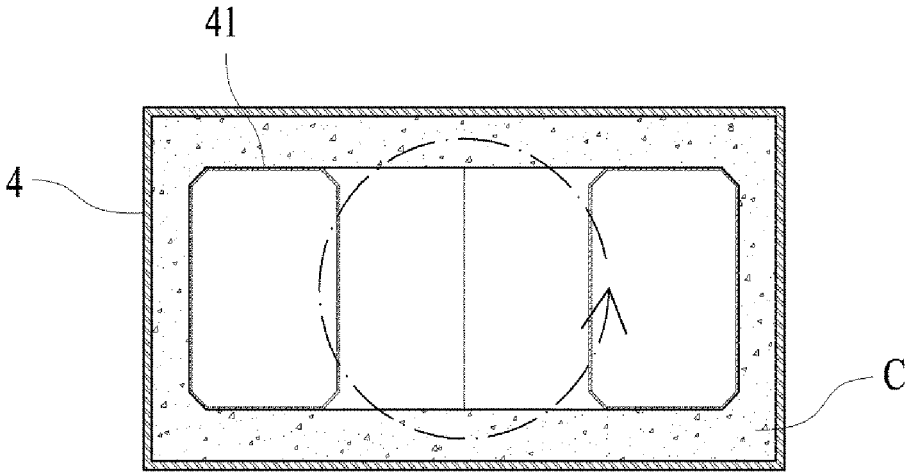

【FIG 12c】
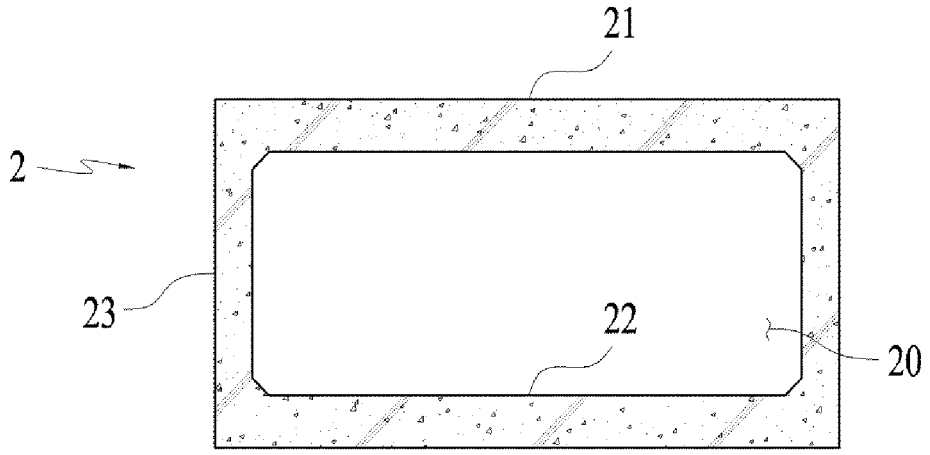
【FIG 13】
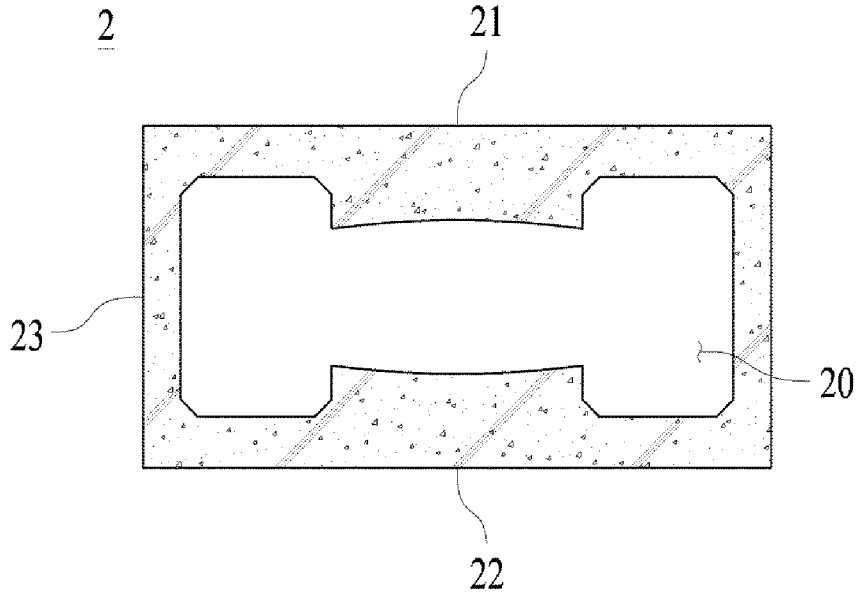

【FIG 14】
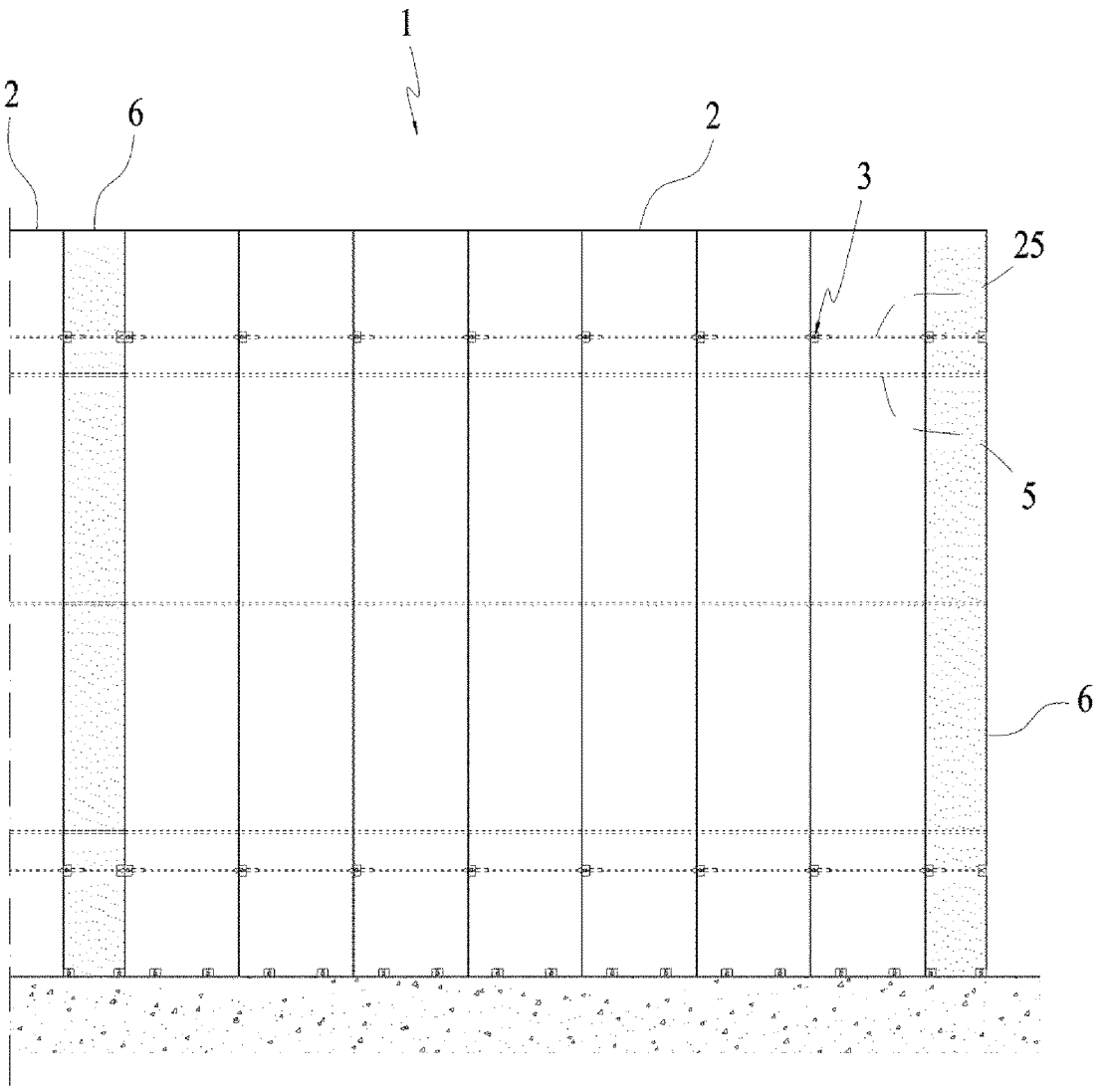

【FIG 15】
52
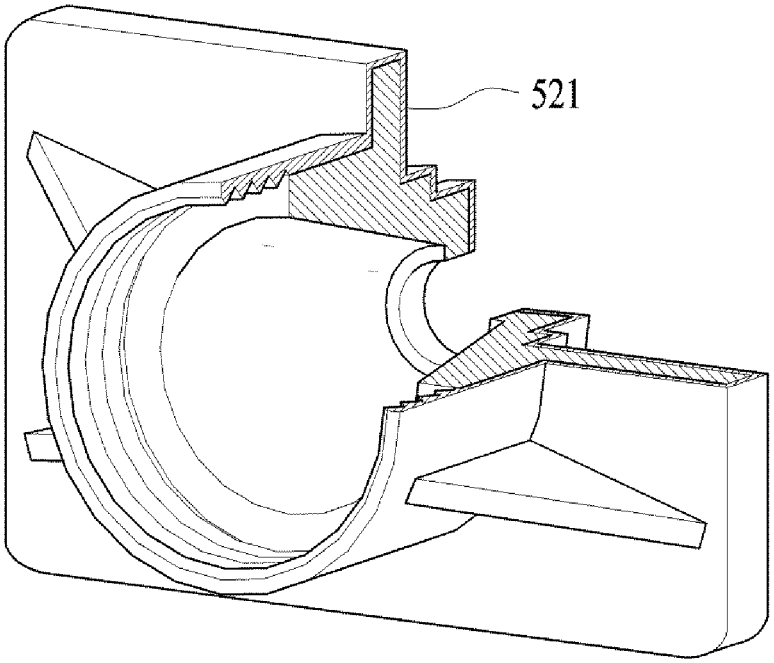

【FIG 16】
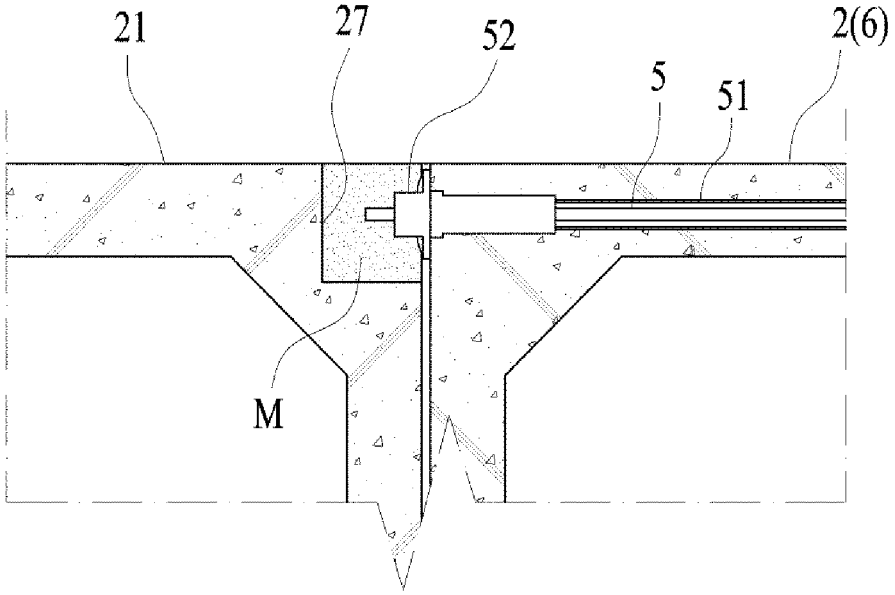
【FIG 17】
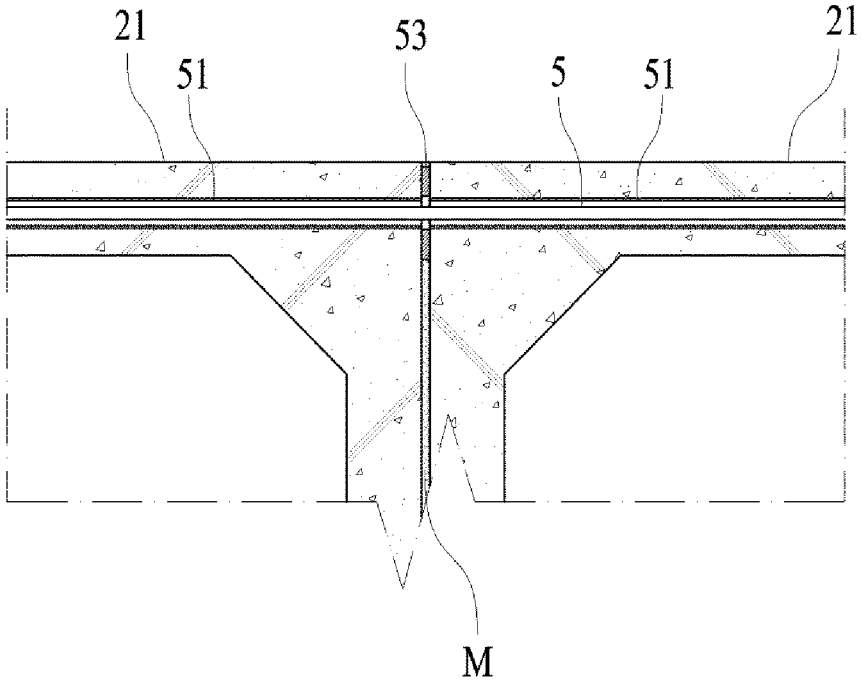

【FIG 18】
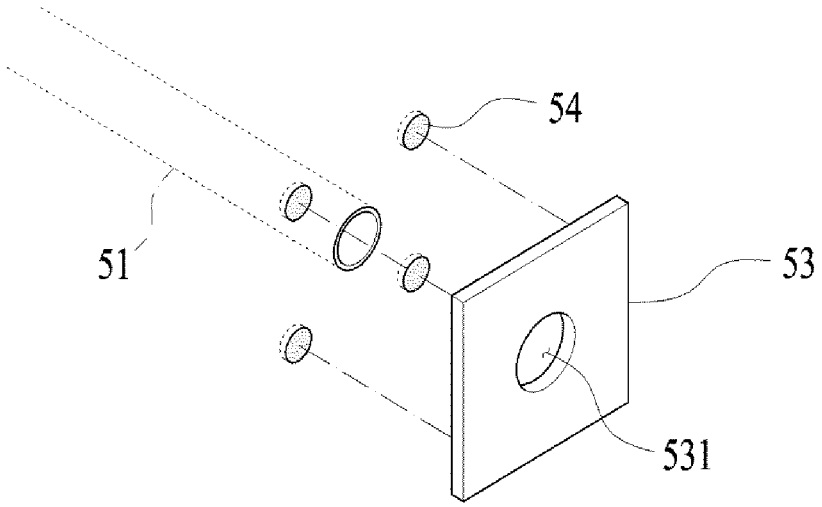

【FIG 19】
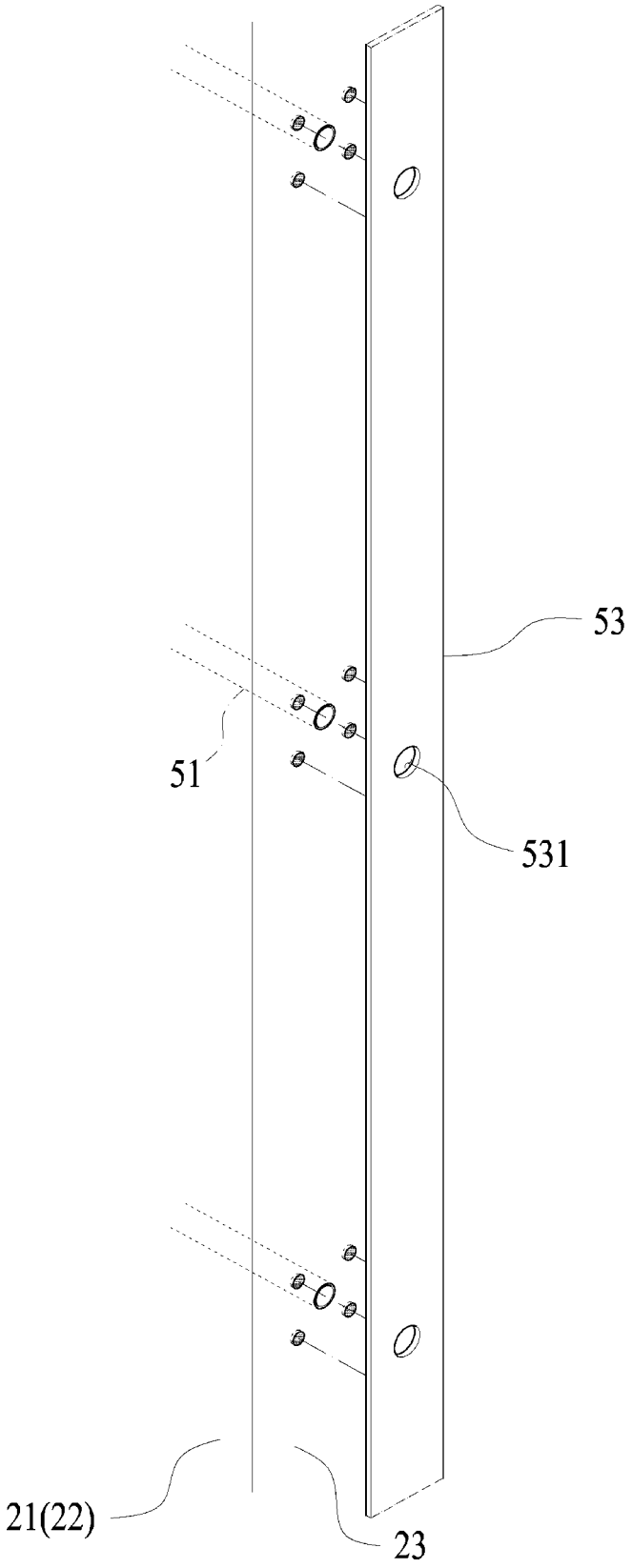

【FIG 20】
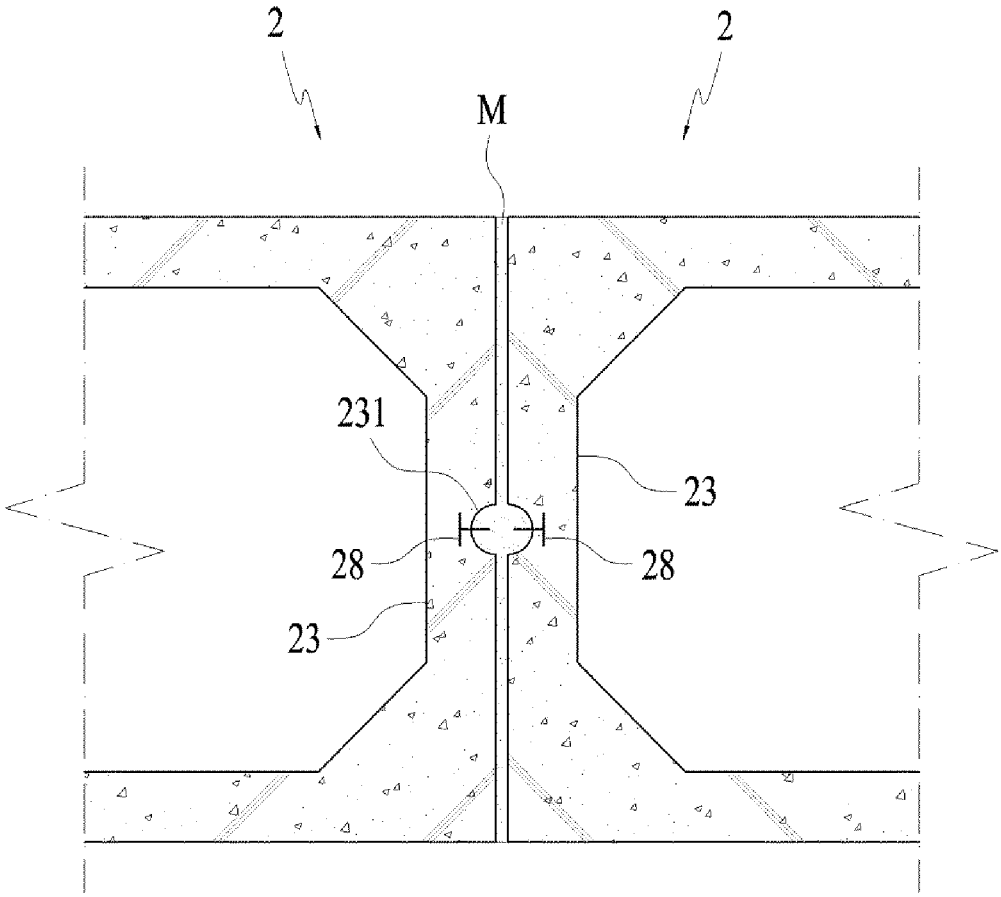

【FIG 21a】
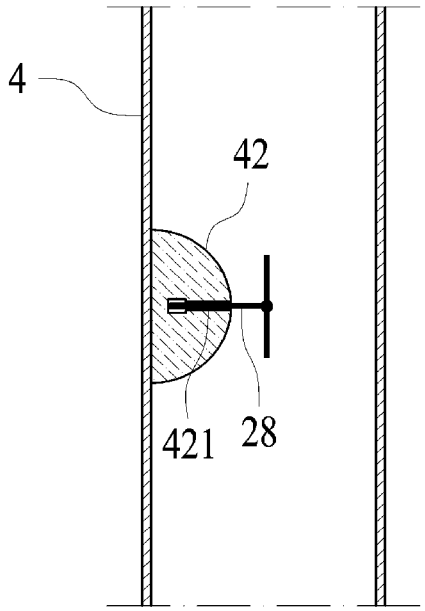
【FIG 21b】
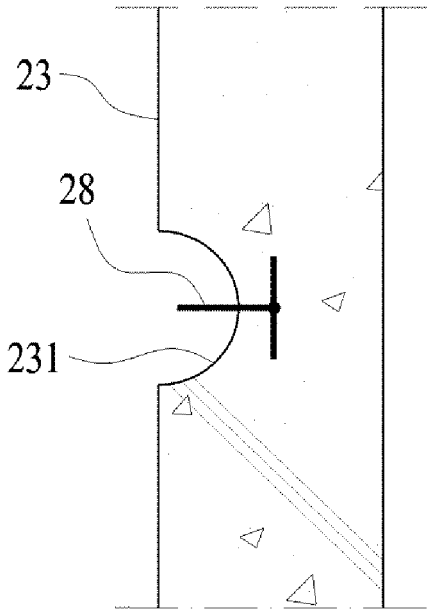

【FIG 22】
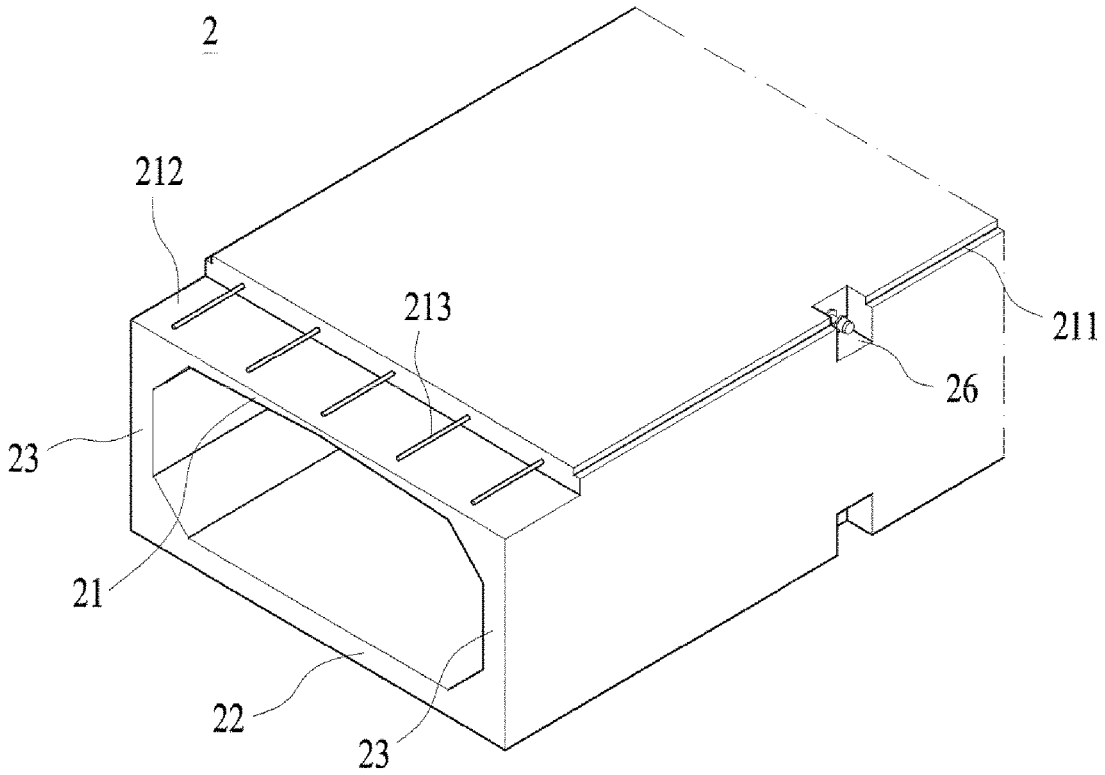

【FIG 23】
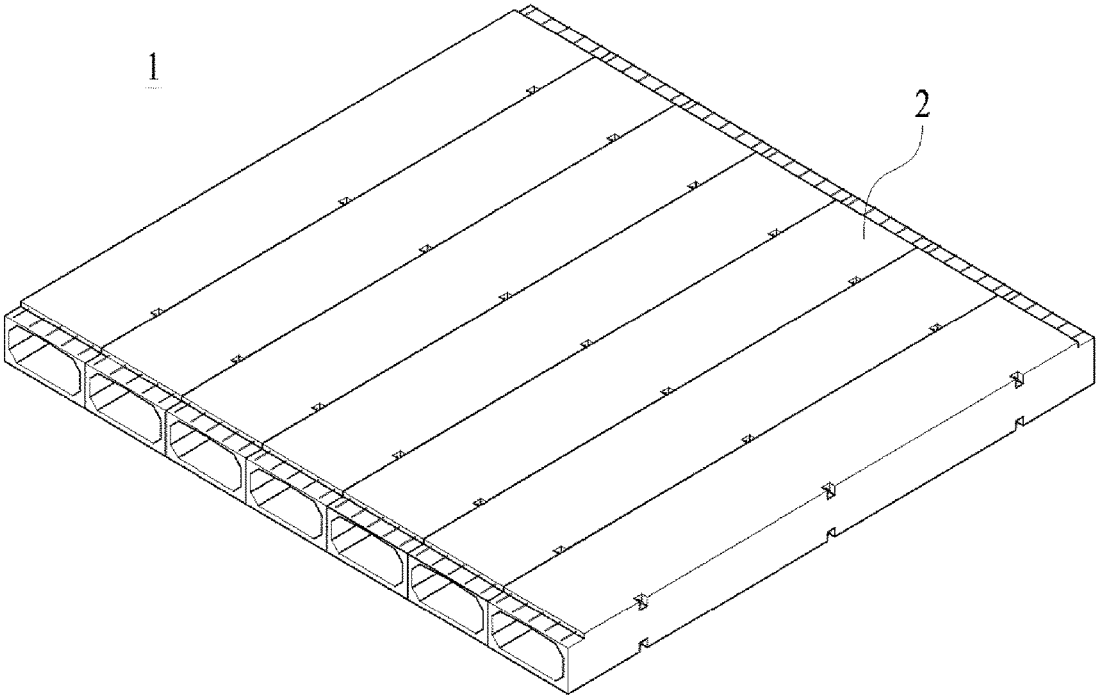

【FIG 24】
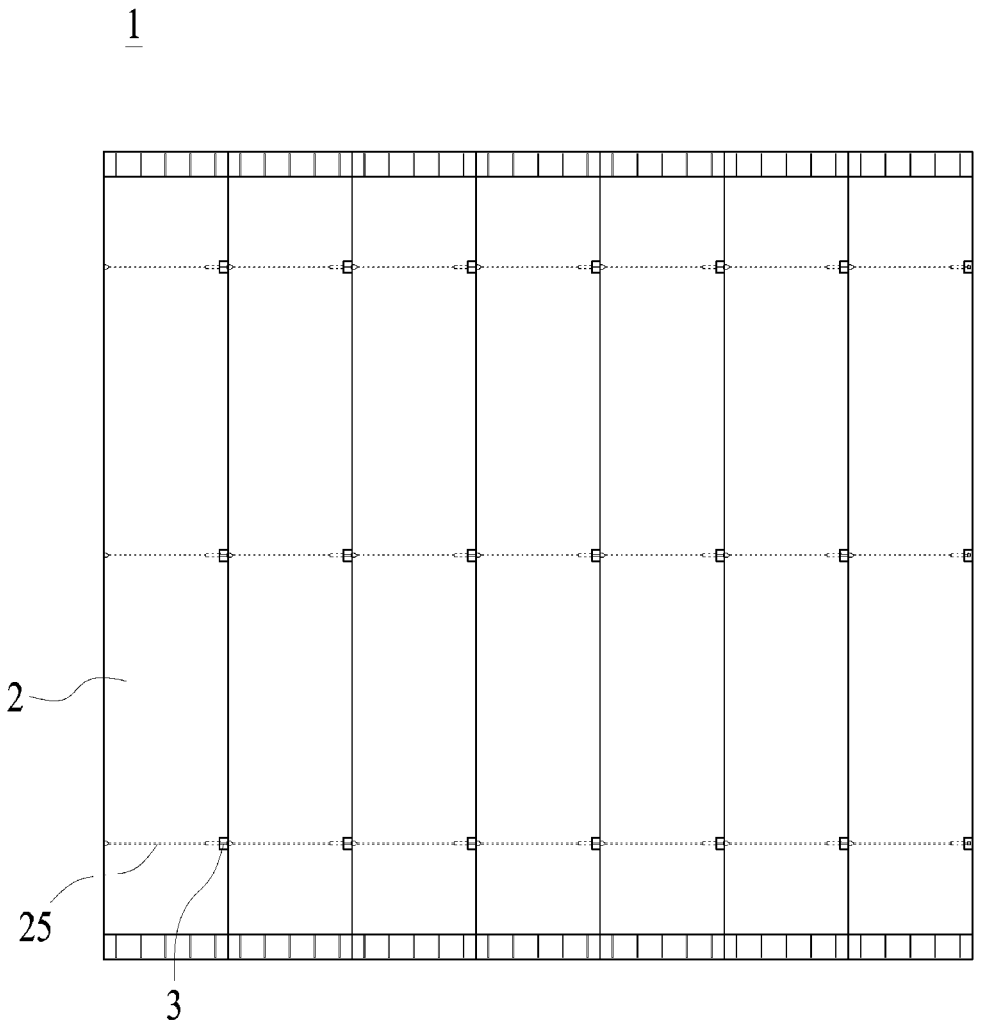

【FIG 25】
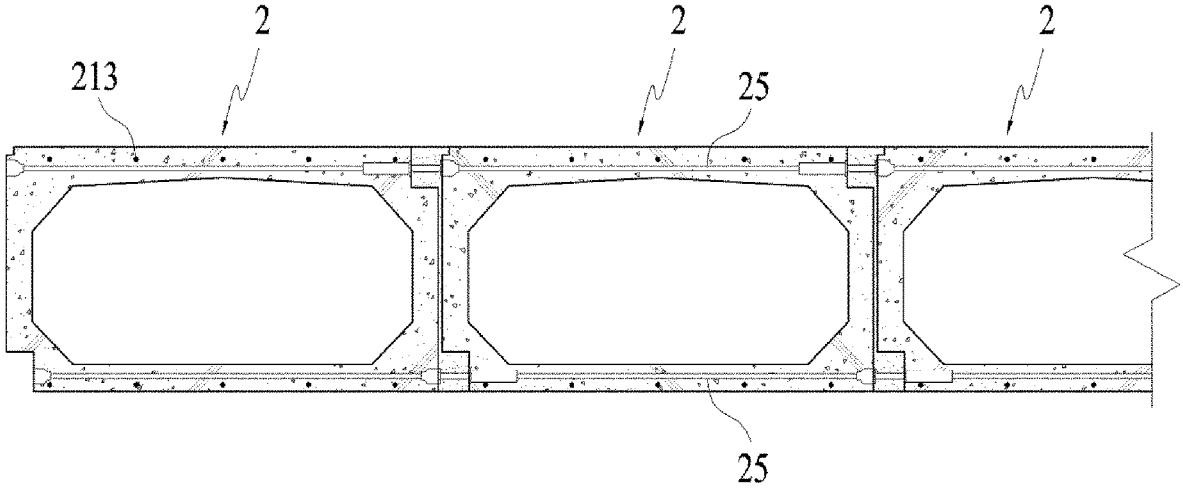

【FIG 26】
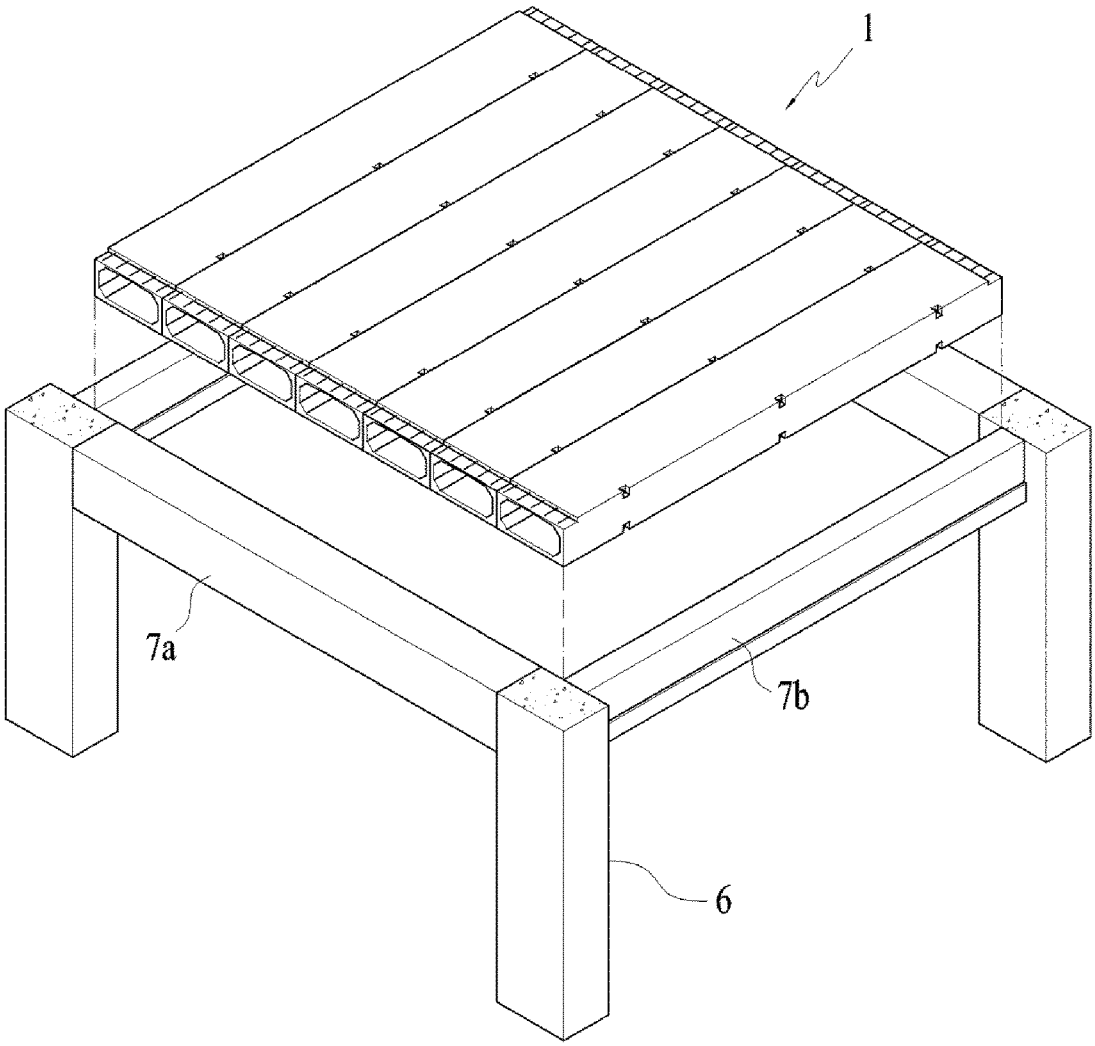

【FIG 27】
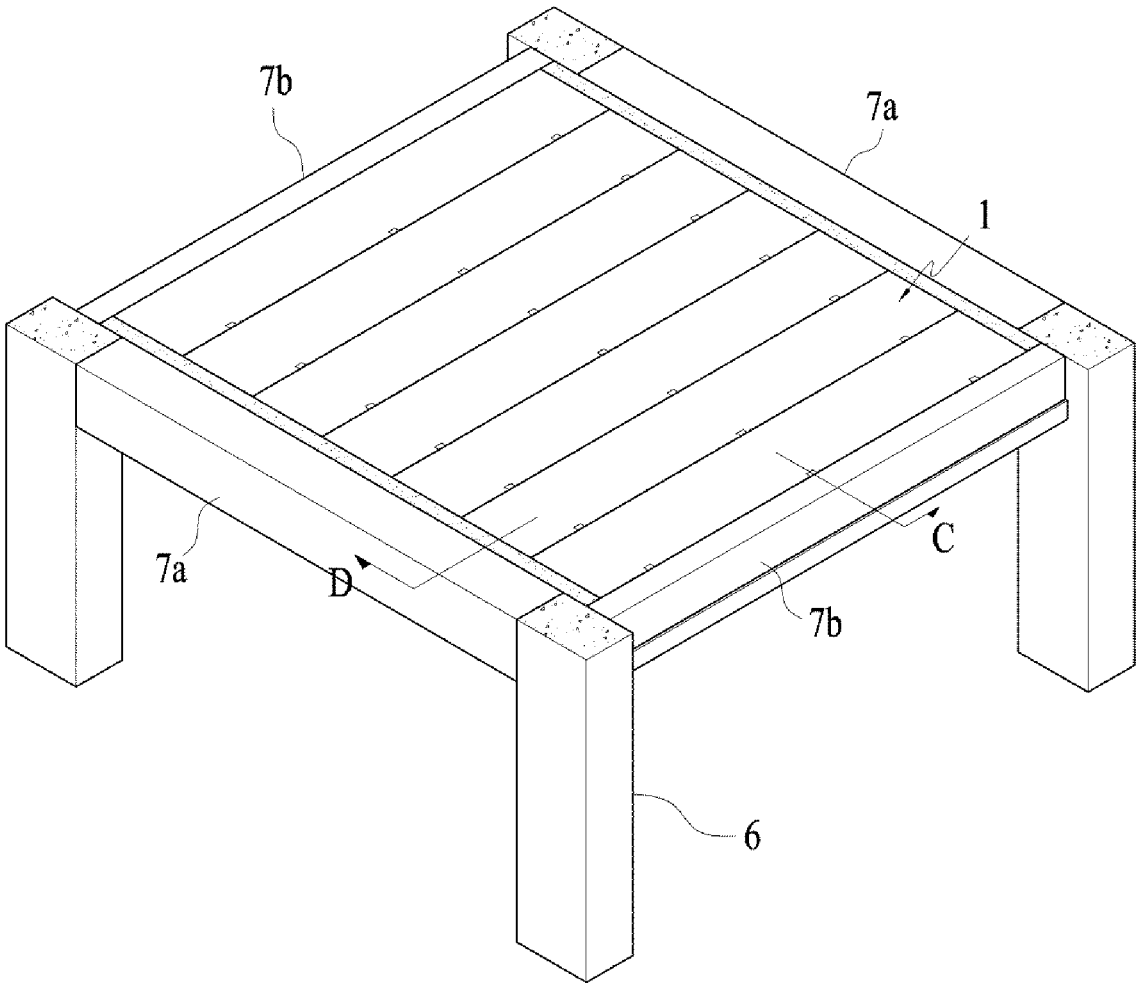

【FIG 28】
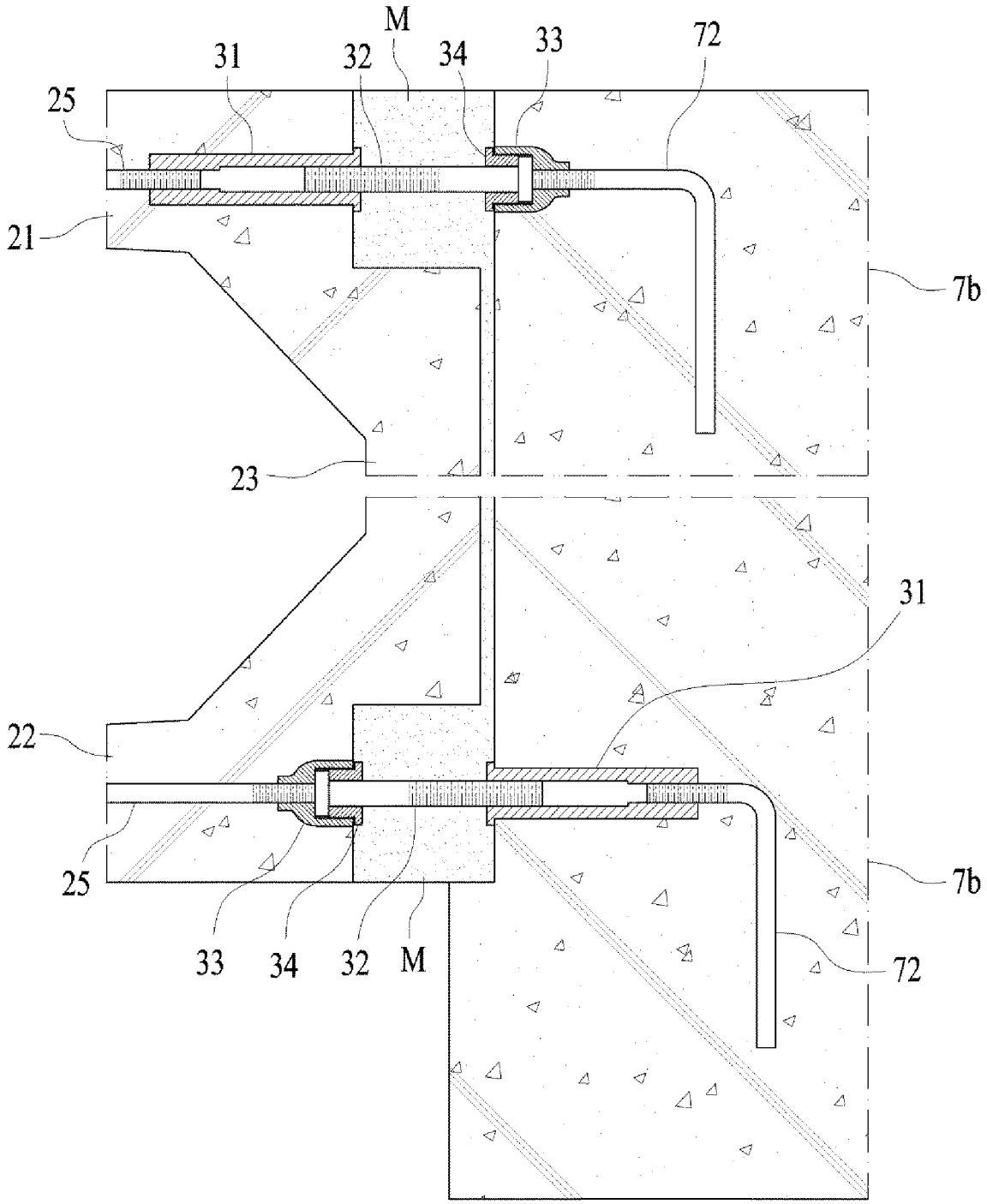

【FIG 29】
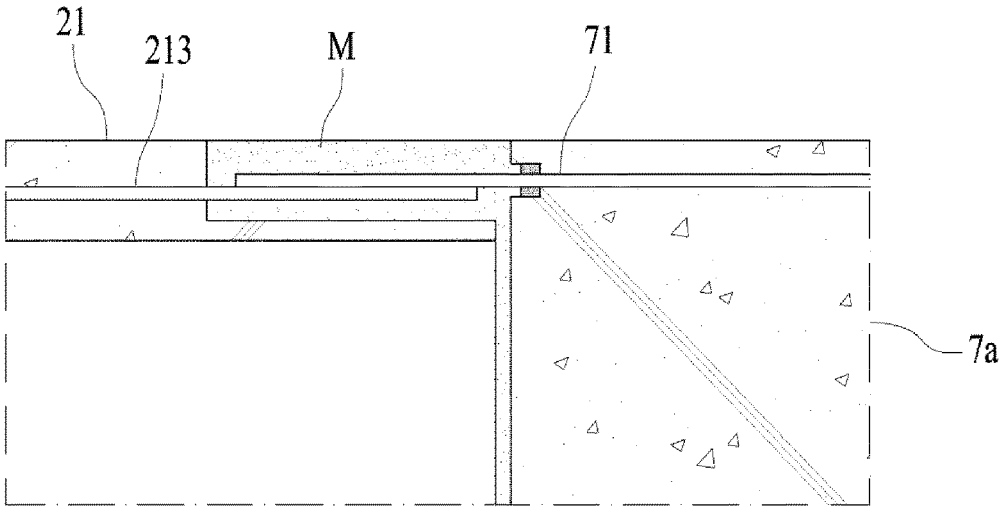
【FIG 30】
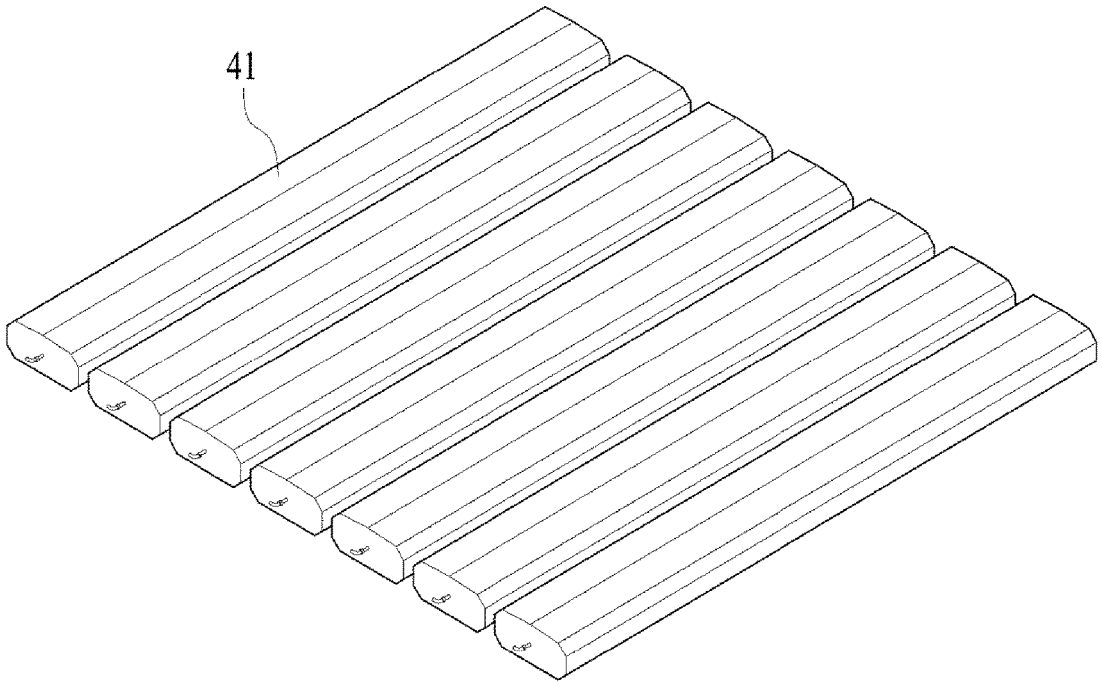

【FIG 31】
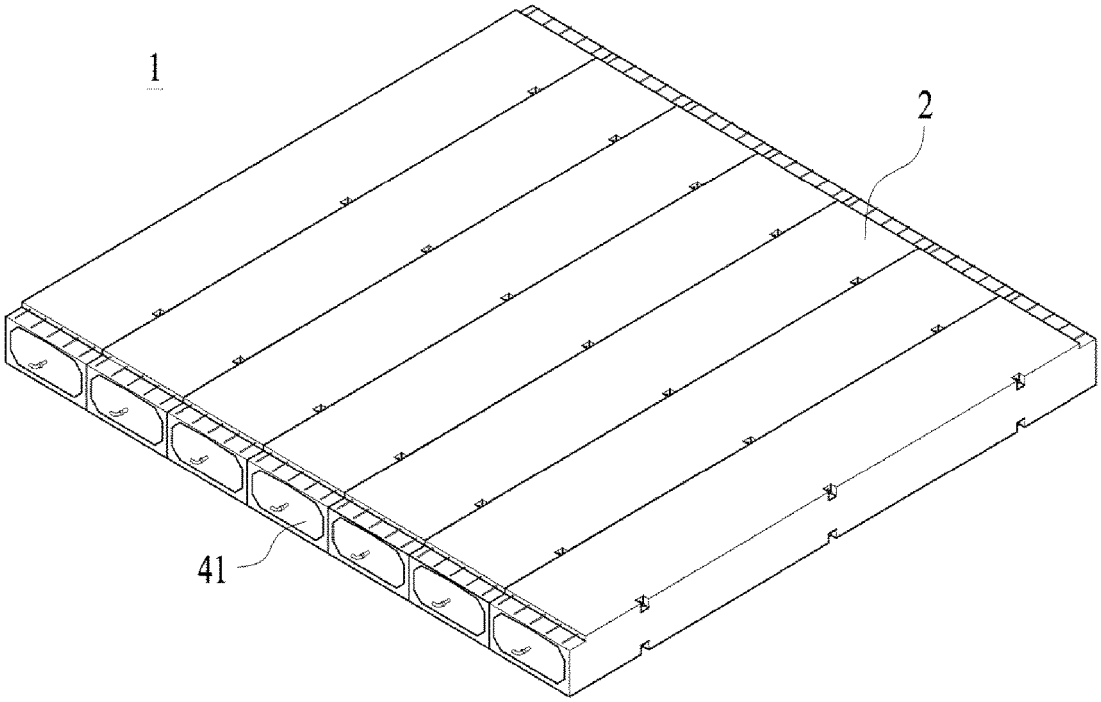

VARIABLE ASSEMBLY PC MEMBER

BACKGROUND OF THE INVENTION

Field of the Invention

The present invention relates to a variable assembly PC member in which a plurality of hollow PC modules comprised of upper and lower flanges and webs so as to have hollows formed therein are coupled with each other in the width direction by using connectors, thereby facilitating enlargement of members and on-site assembly of members through reduction of weight of the PC member, forming members with various sizes, and enabling structural integration in the width direction.

Background Art

A reinforced concrete (RC) structure construction method for constructing a structure by placing concrete after arranging reinforcing bars in a field and installing a mold places a great deal of weight on field work, and is greatly affected by field environments and weather conditions. Therefore, the RC structure construction method has a limit in reduction of a construction period of time and it is difficult to manage quality due to poor precision. Furthermore, the RC structure construction method is manpower-dependent and has a great deal of labor costs. Recently, due to an increase in labor costs, the RC structure construction method is decreased in economic feasibility.

Recently, a precast concrete (PC) construction method which can assemble concrete members, which has been prefabricated in a factory, on the spot is adopted well.

The PC construction method can reduce a construction period of time since reducing the proportion of field work and secure excellent quality, and has less burden on an increase of labor costs and a manpower shortage since the proportion of labor costs is small. However, in a case of a large-sized structure, it is difficult to carry and assemble in a field since the PC member is heavy.

A portion of the cross section of the member is formed as the PC member due to a limitation in hoisting capacity and a problem of integration between the members, and the members are assembled and installed on the field. The rest of the cross section is formed as a half PC member which is formed by placing concrete on the field.

For example, Korean Patent No. 10-1713632 discloses technique of reducing weight by forming hollows arranged in a plurality of columns inside a half PC slab.

However, such a half PC member also has a limitation in reduction of a construction period of time since requiring cast-in-place concrete placement. Furthermore, the half PC member is disadvantageous in vibration and sagging since being applicable only to one-way slab which transfers load in the longitudinal direction of the member.

In addition, Korean Patent No. 10-1776129 discloses a prefabricated precast double structure in which a concrete rib is mounted between upper and lower PC deck plates.

However, the prefabricated precast double structure is difficult to achieve a structural integration with structures neighboring in the width direction. Additionally, the prefabricated precast double structure is difficult to be applicable to structures requiring watertightness, such as wastewater treatment facilities, water tanks, and the likes since fastening bolts must pass through the structure in order to combine upper and lower PC plates and concrete ribs with each other and it is difficult to secure watertightness at a portion connected with the neighboring structure.

SUMMARY OF THE INVENTION

Accordingly, the present invention has been made to solve the above-mentioned problems occurring in the prior arts, and it is an object of the present invention to provide a variable assembly PC member which facilitates enlargement of members and on-site assembly of members due to weight-lightening of the PC member, and enables manufacturing of members having various sizes.

It is another object of the present invention to provide a variable assembly PC member which is capable of achieve structural integration in the width direction as well as in the longitudinal direction.

To accomplish the above object, according to a preferred embodiment of the present invention, there is provided a variable assembly PC member including: a plurality of hollow PC modules, each of which has an upper flange and a lower flange spaced apart from each other, and a pair of webs connecting both ends of the upper flange and the lower flange to form a hollow therein; and connectors connecting the plurality of hollow PC modules with each other in the width direction, wherein a plurality of steel bars are provided on the upper flange and the lower flange of the hollow PC module in the width direction of the hollow PC module, and the connectors connect the steel bars of the neighboring hollow PC modules with each other, and the connector includes: a coupler coupled to an end portion of one side steel bar; a headed bar of which one end is coupled to the coupler and the other end has an expanded head; a socket of which one end is coupled to an end portion of the other side steel bar and the other end has a receiving space for receiving the expanded head of the headed bar; and a fixing cap coupled to the receiving space of the socket to press the expanded head 321 of the headed bar.

According to a preferred embodiment of the present invention, a PC steel wire is disposed to penetrate through the upper flanges and the lower flanges of the plurality of hollow PC modules so as to apply post tension.

According to another preferred embodiment of the present invention, non-shrinkage mortar is filled between the webs of the neighboring hollow PC modules.

According to another preferred embodiment of the present invention, a shim plate is provided around the PC steel wire between the webs of the neighboring hollow PC modules.

According to another preferred embodiment of the present invention, magnets are provided on the web around the PC steel wire of one hollow PC module, and the shim plate is attached to the magnets to fix the position.

According to another preferred embodiment of the present invention, the shim plate is formed long in the longitudinal direction of the hollow PC module, and a through hole through which the PC steel wire penetrates is formed at the position of the PC steel wire.

According to another preferred embodiment of the present invention, a groove portion is formed on the outside of the web of the hollow PC module in the longitudinal direction of the hollow PC module, and a water stop protruding into the groove portion is disposed on the web in the longitudinal direction of the hollow PC module.

In another aspect of the present invention, there is provided a variable assembly PC member which is a PC slab by an All PC method in which cast-in-place concrete is not placed, the variable assembly PC member which is formed by a plurality of hollow PC modules of a rectangular cross section connected in the width direction, each of the hollow PC modules comprising an upper flange, a lower flange, and a pair of webs connecting both ends of the upper flange and the lower flange, and having a hollow formed therein, wherein steel bars are respectively disposed inside the upper flange and the lower flange of the hollow PC module in the width direction of the hollow PC module and an end portion of the steel bar is exposed to a first pocket portion formed at one side end of the upper and lower flanges, and the steel bars of the hollow PC modules abutting in the width direction are connected to each other by a connector inside the first pocket portion, and non-shrinkage mortar is filled between the neighboring hollow PC modules. Both end portions of each hollow PC module are joined to the side surface of a first girder disposed at a longitudinal end portion. The hollow PC module located at the outermost position of the variable assembly PC member is rigidly connected to a fixed steel bar, which is embedded in a second girder disposed at a widthwise end portion of the variable assembly PC member, by a connector.

According to another preferred embodiment of the present invention, the connector of the steel bar includes: a coupler coupled to an end portion of one side steel bar; a headed bar of which one end is coupled to the coupler and the other end has an expanded head; a socket of which one end is coupled to an end portion of the other side steel bar and the other end has a receiving space for receiving the expanded head of the headed bar; and a fixing cap coupled to the receiving space of the socket to press the expanded head of the headed bar.

The variable assembly PC member according to the present invention can be manufactured when the plurality of hollow PC modules comprised of the upper and lower flanges and the webs so as to have hollows formed therein are coupled with each other in the width direction by using the connectors.

Therefore, the variable assembly PC member according to the present invention has less burden in carrying and hoisting due to weight-lightening of the PC member, is easy to construct in a field, and facilitates enlargement of members.

Moreover, the variable assembly PC member according to the present invention enables assembly of the PC members with various sizes due to the modulated width of the hollow PC module, and is effective in manufacturing and management of PC members.

Furthermore, the variable assembly PC member according to the present invention can reduce a construction period of time since the variable assembly PC member is an all PC member which does not require cast-in-place concrete placement and a cast-in-place concrete placing process is omitted.

Additionally, since the steel bars disposed inside the flange in the width direction of the hollow PC module are connected to each other through the connectors, the assembly process for manufacturing the PC member is easy and the members can be integrated in the width direction. Therefore, the variable assembly PC member according to the present invention is structurally advantageous.

In addition, in a case in which the variable assembly PC member is applied to a slab, the hollow PC module gets thicker so as to minimize slab vibration. Therefore, the variable assembly PC member according to the present invention can be easily utilized in factories which produce semiconductors or displays.

BRIEF DESCRIPTION OF THE DRAWINGS

The above and other objects, features and advantages of the present invention will be apparent from the following detailed description of the preferred embodiments of the invention in conjunction with the accompanying drawings, in which:

FIG. 1 is a perspective view illustrating a hollow PC module;

FIG. 2 is a perspective view illustrating a variable assembly PC member according to the present invention;

FIG. 3 is a cross-sectional view illustrating the variable assembly PC member according to the present invention;

FIG. 4 is a perspective view illustrating an example in which the variable assembly PC member is a wall;

FIG. 5 is a perspective view illustrating an example in which the variable assembly PC member is a pillar;

FIG. 6 is a cross-sectional view illustrating a variable assembly PC member according to an embodiment of the present invention;

FIG. 7 is an enlarged view of a portion A of FIG. 1;

FIG. 8 is a perspective view illustrating the hollow PC module at a different angle;

FIG. 9 is an enlarged view of a portion B of FIG. 8;

FIGS. 10A to 10C are perspective views illustrating a steel bar connection process by connectors;

FIGS. 11A to 11C are cross-sectional views illustrating a coupling process of neighboring hollow PC modules;

FIGS. 12A to 12C illustrate a centrifugal molding process of a rectangular hollow by a balloon mold;

FIG. 13 is a cross-sectional view illustrating a hollow PC module in which another form of hollow is formed;

FIG. 14 is a front view illustrating a variable assembly PC member having a PC steel wire;

FIG. 15 is a cross-sectional perspective view illustrating an anchor according to an embodiment of the present invention;

FIG. 16 is a cross-sectional view illustrating a fixed state of an end portion of the PC steel wire;

FIG. 17 is a cross-sectional view illustrating a state in which a shim plate is provided between neighboring hollow PC modules;

FIG. 18 is a view illustrating a coupling relationship of the shim plate by a magnet;

FIG. 19 is a perspective view illustrating an integral shim plate;

FIG. 20 is a cross-sectional view illustrating a coupling relationship of a water stop;

FIGS. 21A and 21B are cross-sectional views illustrating an installation process of the water stop;

FIG. 22 is an enlarged view illustrating an end portion of a hollow PC module for a slab;

FIG. 23 is a perspective view illustrating a variable assembly PC member for a slab;

FIG. 24 is a plan view illustrating the variable assembly PC member for a slab;

FIG. 25 is a cross-sectional view illustrating the variable assembly PC member for a slab;

FIG. 26 is a perspective view illustrating a coupling relationship between the variable assembly PC member for a slab and a girder;

FIG. 27 is a perspective view illustrating an installed state of the variable assembly PC member for a slab;

FIG. 28 is a cross-sectional view illustrating a cross-section C of the variable assembly PC strut member for a slab of FIG. 27;

FIG. 29 is a cross-sectional view illustrating a cross-section D of the variable assembly PC strut member for a slab of FIG. 27;

FIG. 30 is a perspective view illustrating an arrangement of an air injection type balloon mold; and FIG. 31 is a perspective view illustrating a variable assembly PC member for a slab manufactured by the air injection type balloon mold.

BEST MODE

To accomplish the above object, according to the present invention, there is provided a variable assembly PC member including: a plurality of hollow PC modules, each of which has an upper flange and a lower flange spaced apart from each other, and a pair of webs connecting both ends of the upper flange and the lower flange to form a hollow therein; and connectors connecting the plurality of hollow PC modules with each other in the width direction, wherein a plurality of steel bars are provided on the upper flange and the lower flange of the hollow PC module in the width direction of the hollow PC module, and the connectors connect the steel bars of the neighboring hollow PC modules with each other, and the connector includes: a coupler coupled to an end portion of one side steel bar; a headed bar of which one end is coupled to the coupler and the other end has an expanded head; a socket of which one end is coupled to an end portion of the other side steel bar and the other end has a receiving space for receiving the expanded head of the headed bar; and a fixing cap coupled to the receiving space of the socket to press the expanded head of the headed bar.

DETAILED DESCRIPTION OF THE PREFERRED EMBODIMENT

Hereinafter, the present invention will be described in detail with reference to the accompanying drawings and the preferred embodiment.

FIG. 1 is a perspective view illustrating a hollow PC module, FIG. 2 is a perspective view illustrating a variable assembly PC member according to the present invention, and FIG. 3 is a cross-sectional view illustrating the variable assembly PC member according to the present invention As illustrated in FIGS. 1 to 3, the variable assembly PC member according to an embodiment of the present invention includes: a plurality of hollow PC modules 2, each of which has an upper flange 21 and a lower flange 22 spaced apart from each other, and a pair of webs 23 connecting both ends of the upper flange 21 and the lower flange 22 to form a hollow 20 therein; and connectors 3 connecting the plurality of hollow PC modules 2 with each other in the width direction, wherein a plurality of steel bars 25 are provided on the upper flange 21 and the lower flange 22 of the hollow PC module 2 in the width direction of the hollow PC module 2, and the connectors 3 connect the steel bars 25 of the neighboring hollow PC modules 2 with each other. The connector 3 includes: a coupler 31 coupled to an end portion of one side steel bar 25; a headed bar 32 of which one end is coupled to the coupler 31 and the other end has an expanded head 321; a socket 33 of which one end is coupled to an end portion of the other side steel bar 25' and the other end has a receiving space 331 for receiving the expanded head 321 of the headed bar 32; and a fixing cap 34 coupled to the receiving space 331 of the socket 33 to press the expanded head 321 of the headed bar 32.

The present invention is to provide a variable assembly PC member capable of enabling enlargement of members due to weight-lightening of the PC members, facilitating field assembly, allowing manufacturing of members with various sizes, and enabling structural integration in the width direction.

According to the present invention, a plurality of divided hollow PC modules 2 are coupled to each other in the width direction by using connectors 3.

The hollow PC module 2 includes the upper flange 21 and the lower flange 22 spaced apart from each other, and a pair of the webs 23 connecting both ends of the upper flange 21 and the lower flange 22 to form the hollow 20 therein. So, the hollow PC module 2 is generally formed in a box shape having the hollow 20 therein.

The hollow PC module 2 is formed in a square or rectangular cross-section.

A wire mesh (not shown) can be provided in the upper and lower flanges 21 and 22 or the web 23.

The upper and lower flanges 21 and 22 of the hollow PC module 2 form a member finishing surface, and the hollow PC module is an All PC member in which cast-in-place concrete is not placed. Therefore, it is possible to remarkably reduce a construction period of time by omitting a cast-in-place concrete placing process.

Since the hollow PC module 2 is a hollow member in which the hollow 20 is formed, the hollow PC module 2 is lightweight, and so, has less burden in carrying and hoisting and is easy to construct on a site. Moreover, in a case in which the width of the hollow PC module 2 is modularized into dimensions frequently used in construction, PC members having various widths can be assembled by adjusting the number of the hollow PC modules 2 to have the minimum standard, so that the hollow PC member is excellent at manufacturing and management efficiencies of the PC member due to the minimum standard.

The variable assembly PC member 1 can be manufactured by adjusting the hollow PC module 2 having the same size to have various widths according to the size of the entire member. The variable assembly PC member 1 can minimize the weight of unit members since the hollows 20 are aligned in a single row in each hollow PC module 2. Therefore, the hollow PC module 2 is different from a conventional hollow core member having hollow cores aligned in a plurality of rows inside one PC member.

The connectors 3 connect the plurality of hollow PC modules 2 with each other in the width direction.

The neighboring hollow PC modules 2 are connectable to each other by the connectors 3 in the width direction such that the webs 23 are in close contact with each other.

The variable assembly PC member 1 can be manufactured by pre-assembling the plurality of hollow PC modules 2 in a factory, but it is desirable to assemble the plurality of hollow PC modules 2 on a site in consideration of convenience of transportation.

The variable assembly PC member 1 formed by assembling the plurality of hollow PC modules 2 is applicable to various members such as slabs, wall bodies, pillars, beams, and the likes.

In a case in which the variable assembly PC member 1 is applied to a structure requiring watertightness, a waterproof sheet (not shown) is adhered to the side surface of the hollow PC module 2 to prevent water leakage through a connected portion.

As illustrated in FIG. 3, the plurality of steel bars 25 are disposed on the upper flange 21 and the lower flange 22 of the hollow PC module 2 in the width direction of the hollow PC module 2, and the connectors 3 connect the steel bars 25 of the neighboring hollow PC modules 2 with each other.

A plurality of longitudinal reinforcing bars 24 are disposed on the upper flange 21 and the lower flange 22 in the longitudinal direction of the hollow PC module 2.

The variable assembly PC member 1, which is formed by connecting the plurality of hollow PC modules 2 elongated in the longitudinal direction of the member, can transfer load since the longitudinal reinforcing bars 24 are continued in the longitudinal direction. However, it is impossible to transfer load since the reinforcing bars 24 are divided in the width direction.

Therefore, in order to structurally seriate the members in the longitudinal direction as well as in the longitudinal direction, the steel bars 25 are arranged in the width direction of the hollow PC module 2 inside the upper flange and the lower flange 22, and the steel bars 25 of the neighboring hollow PC modules 2 are connected to each other by the connectors 3.

In a case in which the variable assembly PC member 1 is a two-way slab, it can reduce vibration and sagging and minimize the thickness of the member.

Moreover, in a case in which the variable assembly PC member 1 is a wall body, the neighboring hollow PC modules 2 come into close contact with each other by the connectors 3, thereby improving watertightness.

In addition, in a case in which the variable assembly PC member 1 is a beam, the steel bars 25 are connected to each other by the connectors 3 so as to serve as a stirrup, thereby supporting a shearing force.

The steel bars 25 may be reinforcing bars.

FIG. 4 is a perspective view illustrating an example in which the variable assembly PC member is a wall, FIG. 5 is a perspective view illustrating an example in which the variable assembly PC member is a pillar, and FIG. 6 is a cross-sectional view illustrating a variable assembly PC member according to an embodiment of the present invention As illustrated in FIG. 4, in a case in which the variable assembly PC member 1 of the present invention is a wall body, the hollow PC module 2 can be joined to a neighboring pillar 6 using the connectors 3 for connecting the hollow PC modules 2 in the same way.

In this case, the hollow PC module 2 can be fixed to a lower base 8 of the wall body by the connectors 3.

The variable assembly PC member 1 according to the present invention may be used as a pillar as illustrated in FIG. 5, or may be used as a beam as illustrated in FIG. 6.

In a case in which the variable assembly PC member 1 is used as a pillar or a beam, the variable assembly PC member 1 can be formed by a single item of the hollow PC module 2.

FIG. 7 is an enlarged view of a portion A of FIG. 1, FIG. 8 is a perspective view illustrating the hollow PC module at a different angle, FIG. 9 is an enlarged view of a portion B of FIG. 8, FIGS. 10A to 10C are perspective views illustrating a steel bar connection process by connectors, and FIGS. 11A to 11C are cross-sectional views illustrating a coupling process of neighboring hollow PC modules.

As illustrated in FIGS. 7 to 11C, the connector 3 includes; a coupler 31 coupled to an end portion of one side steel bar 25; a headed bar 32 of which one end is coupled to the coupler 31 and the other end has an expanded head 321; a socket 33 of which one end is coupled to an end portion of the other side steel bar 25' and the other end has a receiving space 331 for receiving the expanded head 321 of the headed bar 32; and a fixing cap 34 coupled to the receiving space 331 of the socket 33 to press the expanded head 321 of the headed bar 32.

The neighboring steel bars 25 and 25' are joined to get in close contact with each other without any clearance to absorb a construction error. So, the neighboring steel bars 25 and 25' can be joined to each other by mechanical joint so as to stably transfer a load with respect to a tensile force and a compression force.

In order to achieve the above, the connector 3 includes the coupler 31, the headed bar 32, the socket 33, and the fixing cap 34.

The coupler 31 is coupled to one end of the steel bar 25, and the headed bar 32 having the expanded head 321 is coupled to the coupler 31 to be exposed to the outside, and the fixing cap 34 is disposed outside the headed bar 32.

The socket 33 is coupled to the other end of the steel bar 25, and is embedded in the hollow PC module 2 so that an inlet of the receiving space 331 can be exposed.

Therefore, one end of the steel bar 25 of one hollow PC module 2 can be coupled to the other end of the steel bar 25' of the other hollow PC module 2'.

The receiving space 331 opened at the front is formed in the socket 33, and a female screw thread can be formed on the inner circumferential surface of the receiving space 331.

The fixing cap 34 has a screw thread formed on the outer circumferential surface thereof so as to be screw-coupled to the inside of the receiving space 331 of the socket 33, and the headed bar 32 is configured to penetrate the center.

The fixing cap 34 may have a tool coupling part 341 formed on the rear outer surface thereof to allow rotation of the fixing cap 34 by a tool. The tool coupling part 341 may be formed in a polygonal shape to facilitate tool coupling.

A first pocket portion (26) may be formed at an end portion of the steel bar 25 on the side of the coupler 31 so that the headed bar 32 and the socket 33 can be exposed to the outside.

Since the connector 3 can support both compression and tension, the same connectors 3 can be used for both the upper and lower portions of the hollow PC module 2.

Referring to FIGS. 10A to 10C and 11A to 11C, a coupling process of the neighboring hollow PC modules 2 will now be described.

First, in a state in which the headed bar 32 is retracted toward the coupler 31 so as not to protrude to the side surface of one hollow PC module 2, the other hollow PC module 2' is installed to come into close contact with the one hollow PC module 2 (See FIGS. 10A and 11A).

Next, the headed bar 32 is advanced to be inserted into the receiving space 331 inside the socket 33 of the other hollow PC module 25'. In this instance, the joint clearance between the neighboring hollow PC modules 2 and 2' is removed, and the front surface of the expanded head 321 of the headed bar comes into close contact with the bottom surface of the receiving space 331 to transfer a compressive force (See FIG. 10B and FIG. 11B).

In addition, the fixing cap 34 is screw-coupled to the inside of the receiving space 331 of the socket 33 so that the front end presses the rear surface of the expanded head 321 of the headed bar 32 (See FIG. 10C and FIG. 11C).

As described above, the neighboring steel bars 25 and 25' are coupled to each other by the connectors 3, and then, the first pocket portion 26 is filled with non-shrinkage mortar M.

When both steel bars 25 and 25' are mutually connected and fixed by means of such a screw coupling, it is possible to perform work rapidly and stably support stress directly after the coupling.

FIGS. 12A to 12C illustrate a centrifugal molding process of a rectangular hollow by a balloon mold, and FIG. 13 is a cross-sectional view illustrating a hollow PC module in which another form of hollow is formed.

The hollow PC module 2 can use a plastic sphere to form the hollow 20 during manufacture. However, the plastic sphere is heavy, requires lots of production costs, and is difficult to be removed after completion of manufacturing. In addition, it is difficult to form a large hollow hole due to a limitation in rigidity and weight.

Therefore, it is preferable to form the hollow 20 by using air injection type balloon molds 41 or by centrifugal molding.

Especially, in a case in which the hollow 20 is formed by centrifugal molding, the entire outer surface of the hollow PC module 2 is formed by the mold 4, and thus a high-quality hollow PC module 2 can be manufactured.

Meanwhile, in a case in which the hollow 20 is rectangular, the rectangular hollow 20 cannot be formed by general centrifugal molding. Therefore, as illustrated in FIG. 12A, the balloon molds 41 are arranged on both sides of the hollow 20, and the mold 4 is partially filled with concrete C. As illustrated in FIG. 12C, a hollow is formed even between the balloon molds 41, so that the hollow 20 of a generally rectangular shape is formed.

As described above, in a case in which the hollow 20 is manufactured by the balloon molds 41 and the centrifugal molding, the hollow PC module 2 which can maximize the size of the hollow 20 and has with excellent quality can be manufactured.

The hollow 20 can be formed in various shapes according to the rotational speed of the mold 4 (FIG. 13).

FIG. 14 is a front view illustrating a variable assembly PC member having a PC steel wire, FIG. 15 is a cross-sectional perspective view illustrating an anchor according to an embodiment of the present invention, and FIG. 16 is a cross-sectional view illustrating a fixed state of an end portion of the PC steel wire.

As illustrated in FIGS. 14 to 16, a PC steel wire 5 is disposed in the upper flanges 21 and the lower flanges 22 of the plurality of hollow PC modules 2 to pass through, so that post-tension can be applied.

In order to firmly maintain joining between the plurality of hollow PC modules 2 divided in the width direction of the variable assembly PC member 1, the PC steel wire 5 passes through the upper flanges 21 and the lower flanges 22 of the plurality of hollow PC modules 2, and in this instance, the PC steel wire 5 is tensed to apply post-tension.

In this case, the variable assembly PC member according to the present invention can secure high reliability with respect to waterproofing performance through high water-tightness when the variable assembly PC member according to the present invention is applied to a reservoir wall body.

In order to achieve the above, ducts 51 of a plurality of rows through which the PC steel wire 5 passes in the width direction of each hollow PC module 2 can be disposed in the upper flange 21 and the lower flange 22 of the hollow PC module 2 (FIG. 16).

An end portion of the PC steel wire 5 can be fixed by an anchor 52.

In order to prevent corrosion of the anchor 52, the outer circumferential surface of the anchor 52 can be surrounded by an encapsuling portion 521 made of a polymer material (FIG. 15).

The PC steel wire 5 can prevent corrosion by using a covering tendon.

A second pocket portion 27 for receiving the anchor 52 may be formed at an end portion of the outermost hollow PC module 2 of the variable assembly PC member 1. In this instance, the end portion of the PC steel wire 5 is fixed by the anchor 52, and then, the second pocket portion 27 is filled with non-shrinkage mortar M.

In a case in which the end portion of the variable assembly PC member 1 is joined to side surfaces of the pillar 6 or a girder 7*a* or 7*b* which will be described later, the PC steel wire 5 can be fixed by the anchor 52 on the pillar 6 or the girder 7*a* or 7*b* after penetrating through the member, such as the pillar 6 or the girder 7*a* or 7*b*.

Especially, the end portion of the variable assembly PC member 1 is coupled to the slab, the PC steel wire 5 is further resistant to a negative moment of the end portion.

In a case in which the divided PC members are coupled by applying a post-tension to the PC steel wire, a support is required until post-tension is applied. On the other hand, since the post-tension is applied in a state in which the hollow PC modules 2 are connected by the connectors 3, the present invention does not need to be supported by the support.

FIG. 17 is a cross-sectional view illustrating a state in which a shim plate is provided between neighboring hollow PC modules.

As illustrated in FIG. 17, non-shrinkage mortar M can be filled between the webs 23 of the neighboring hollow PC modules 2.

Even though the hollow PC modules 2 are manufactured delicately, a gap is formed between the two neighboring hollow PC modules 2 when the two neighboring hollow PC modules 2 are in contact with each other. Furthermore, in a case in which an end portion of the duct 51 for inserting the PC steel wire 5 protrudes outward from the web 23, a predetermined gap is formed between the neighboring hollow PC modules 2, and in this case, a tension force introduced to the PC steel wire 5 may be lost.

Therefore, the non-shrinkage mortar M is filled between the neighboring hollow PC modules 2 so as not to form a gap.

Since the neighboring hollow PC modules 2 are supported by separate connectors 3, it is easy to secure a space for filling the non-shrinkage mortar M.

In addition, in a case in which the non-shrinkage mortar M is charged, when a tension force is applied to the PC steel wire 5, a compressive force is supported, and vibration of the variable assembly PC member 1 is minimized.

As illustrated in FIG. 17, a shim plate 53 can be provided around the PC steel wire 5 between the webs 23 of the neighboring hollow PC modules 2.

In a case in which the non-shrinkage mortar M is filled between the neighboring hollow PC modules 2, after the non-shrinkage mortar M is hardened, post-tension is applied to the PC steel wire 5. So, the construction period of time may be delayed.

Therefore, a shim plate 53 supports between the neighboring hollow PC module 2 to tense the PC steel wire 5 before the non-shrinkage mortar M is charged, thereby quickly performing construction.

The shim plate 53 is arranged around the PC steel wire 5 to directly support the tension force of the PC steel wire 5 when post-tension is applied to the PC steel wire 5.

The shim plate 53 has a through hole (531) formed in the middle thereof, and the PC steel wire 5 can be penetrated (FIG. 18).

The shim plate 53 can prevent the non-shrinkage mortar M from penetrating into the duct 51.

The shim plate 53 can be made of a metal material. Alternatively, the shim plate 53 may be a mono cast (MC) nylon plate which is excellent at mechanical strength and is inexpensive.

In a case in which the shim plate 53 is the MC nylon plate, the shim plate 53 can be attached to one hollow PC module 2 by an adhesive.

FIG. 18 is a view illustrating a coupling relationship of the shim plate by a magnet.

As illustrated in FIGS. 18 and 19, magnets 54 are provided on a web 23 around the PC steel wire 5 of one hollow PC module 2, and the shim plate 53 is attached to the magnets 54 to fix the position.

Since it is difficult to install the shim plate 53 after both of the hollow PC modules 2 are assembled, it is preferable that the shim plate 53 is previously fixed on the side surface of the one hollow PC module 2.

Finally, the magnets 54 are embedded in one side web 23 of the hollow PC module 2 so as to attach and fix the shim plate 53 by a magnetic force.

In this case, the shim plate 53 is a steel plate.

FIG. 19 is a perspective view illustrating an integral shim plate.

As illustrated in FIG. 19, the shim plate 53 is elongated in the longitudinal direction of the hollow PC module 2, and the through hole 531 through which the PC steel wire 5 penetrates may be formed at the position of the PC steel wire 5.

The shim plate 53 may be individually installed at each position of the PC steel wire 5. As illustrated in FIG. 19, a plurality of shim plates 53 may be connected into one.

Accordingly, the shim plates 53 are formed in the shape of a long band plate, and the through hole 531 is formed at each position of each PC steel wire 5 to be fixed on the one hollow PC module 2.

In this case, since the plurality of shim plates 53 are continued into a single band plate, an installation period of time of the shim plate 53 can be reduced.

In addition, since the shim plate 53 is arranged to be long in the longitudinal direction on the side surface of the hollow PC module 2, additional waterproof performance can be secured.

FIG. 20 is a cross-sectional view illustrating a coupling relationship of a water stop, and FIGS. 21A and 21B are cross-sectional views illustrating an installation process of the water stop.

As illustrated in FIGS. 20, 21A and 21B, a groove portion 231 is formed on the outside of the web 23 of the hollow PC module 2 in the longitudinal direction of the hollow PC module 2, and a water stop 28 protruding into the groove portion 231 is disposed on the web 23 in the longitudinal direction of the hollow PC module 2.

In a case in which the variable assembly PC member 1 is applied to a structure requiring watertight performance, such as a water tank, water leakage should not occur at the coupled portion between the neighboring hollow PC modules 2.

Especially, in a case in which non-shrinkage mortar M is filled between the neighboring hollow PC modules 2, water leakage may be generated by the interface between the non-shrinkage mortar M and the hollow PC module 2.

Therefore, the groove portion 231 is formed on the outer surface of the web 23 of the hollow PC module 2 in the longitudinal direction of the hollow PC module 2, and the water stop 28 protrudes into the groove portion 231.

The groove portion 231 is filled with non-shrinkage mortar M, and the water stop 28 is provided across the facing surface between the non-shrinkage mortar M and the web 23 of the hollow PC module 2, thereby preventing water leakage through the interface between different materials.

The water stop 28 can be formed in a T-shape so as to be firmly fixed inside the web 23 of the hollow PC module 2.

The water stop 28 can be mounted through the following process.

First, when the hollow PC module 2 is manufactured, a rubber stopper 42 having a semi-circular cross section is attached to the inner surface of a mold 4 of a web 23, and then, one end of the water stop 28 is inserted into a cut portion 421 formed inside the rubber stopper 42 to be fixed (FIG. 21A).

Thereafter, concrete C is poured, and then, the rubber stopper 42 is removed to complete the mounting work of the water stop 28 (FIG. 21B).

FIG. 22 is an enlarged view illustrating an end portion of a hollow PC module for a slab, FIG. 23 is a perspective view illustrating a variable assembly PC member for a slab, FIG. 24 is a plan view illustrating the variable assembly PC member for a slab; and FIG. 25 is a cross-sectional view illustrating the variable assembly PC member for a slab.

As illustrated in FIGS. 22 to 24, the present invention includes a variable assembly PC member 1, which is a PC slab by the All PC method in which cast-in-place concrete is not placed.

The variable assembly PC member 1 comprises an upper flange 21, a lower flange 22, and a pair of webs 23 connecting both ends of the upper flange 21 and the lower flange 22, a plurality of hollow PC modules 2 having a rectangular cross section, each of which has a hollow 20 formed therein, are connected in the width direction. Steel bars 25 are respectively disposed inside the upper flange 21 and the lower flange 22 of the hollow PC module 2 in the width direction of the hollow PC module 2 and an end portion of the steel bar is exposed to a first pocket portion 26 formed at one side end of the upper and lower flanges 21 and 22. The steel bars 25 of the hollow PC modules 2 abutting in the width direction are connected to each other by a connector 3 inside the first pocket portion 26, and non-shrinkage mortar M is filled between the neighboring hollow PC modules 2. Both end portions of each hollow PC module 2 are joined to the side surface of a first girder 7*a* disposed at a longitudinal end portion. The hollow PC module 2 located at the outermost position of the variable assembly PC member 1 is rigidly connected to a fixed steel bar 72, which is embedded in a second girder 7*b* disposed at a widthwise end portion of the variable assembly PC member 1, by a connector 3.

In a case in which the variable assembly PC member 1 is used as a slab, the variable assembly PC member 1 can reduce a construction period of time by reducing vibration and minimizing field work, thereby being applicable to semiconductor or display production factories, or the likes.

As illustrated in FIGS. 23 to 24, the plurality of hollow PC modules 2 are coupled to each other in the width direction to form a variable assembly PC member 1 for a slab.

Since the upper flange 21 of the hollow PC module 2 becomes the upper surface of the bottom, the hollow PC module 2 can be constructed by the All PC method in which cast-in-place concrete is not placed. Accordingly, the present invention can greatly reduce the construction period of time by rapid construction.

In order to block a gap between the hollow PC modules 2 neighboring in the width direction, first stepped portions 211 are respectively formed at both end portions of the upper surface of the hollow PC module 2 (FIG. 22).

After the hollow PC modules 2 are installed, non-shrinkage mortar M is filled in the first stepped portions 211.

In addition, as illustrated in FIG. 25, the non-shrinkage mortar M is filled between the neighboring hollow PC modules 2 so as to minimize vibration of the variable assembly PC member 1.

The hollow PC module 2 is formed to be sufficiently thick, thereby minimizing slab vibration.

The existing RC method or the conventional half PC slab require upper surface flattening work after slab concrete placement. However, the present invention does not require upper surface flattening work since being manufactured in a factory and the flat upper surface of the hollow PC module 2 is exposed as it is.

FIG. 26 is a perspective view illustrating a coupling relationship between the variable assembly PC member for a slab and a girder, and FIG. 27 is a perspective view illustrating an installed state of the variable assembly PC member for a slab.

As illustrated in FIGS. 26 and 27, the first girder 7*a* and the second girder 7*b* are installed in both directions between a plurality of pillars 6 arranged to be spaced apart from each other, and then, end portions of the variable assembly PC member 1 formed by assembling the plurality of hollow PC modules 2 can be constructed to be fixed on the first girder 7*a* and the second girder 7*b*.

In this instance, in the variable assembly PC member 1 formed by assembling the plurality of hollow PC modules 2, both end portions of each hollow PC module 2 are coupled to the side surface of the first girder 7*a* disposed at the longitudinal end portion. Moreover, the hollow PC module 2 located at the outermost position of the variable assembly PC member 1 is rigidly connected to a fixed steel bar 72, which is embedded in the second girder 7*b* disposed at the widthwise end portion of the variable assembly PC member 1, by a connector 3.

A stepped portion is formed at a lower portion of the first girder 7*a* or the second girder 7*b* for holding the variable assembly PC member 1.

The variable assembly PC member 1 can be formed by assembling the plurality of hollow PC modules 2 in a factory or on a site.

The entire of the assembled variable assembly PC member 1 may be hoisted on a site to be installed. Alternatively, the variable assembly PC member 1 may be formed in such a way that each of the hollow PC modules 2 are hoisted, end portions of the hollow PC module 2 are held on the first girders 7*a* located at both sides, and the neighboring hollow PC modules 2 are coupled to each other.

A PC steel bar (not shown) is disposed in the upper flange 21 and the lower flange 22 of the hollow PC module 2 in the longitudinal direction of the hollow PC module 2 so as to apply pre-tension to the hollow PC module 2.

The present invention can suppress generation of a crack of the hollow PC module 2 due to the application of pre-tension, thereby minimizing floor vibration.

FIGS. 28 and 29 are cross-sectional views respectively illustrating a cross-section C and a cross-section D of the variable assembly PC strut member for a slab of FIG. 27.

As illustrated in FIGS. 25 and 28, the steel bars 25 are respectively disposed inside the upper flange 21 and the lower flange 22 of the hollow PC module 2 in the width direction of the hollow PC module 2 and an end portion of the steel bar is exposed to the first pocket portion 26 formed at one side end of the upper and lower flanges 21 and 22. The steel bars 25 of the hollow PC modules 2 abutting in the width direction are connected to each other by a connector 3 inside the first pocket portion 26.

The hollow PC module 2 is formed to be long in the longitudinal direction of the variable assembly PC member 1, and is combined with another hollow PC module 2 neighboring in the width direction so as to form a variable assembly PC member 1 for a slab.

The steel bar 25 is embedded in the width direction inside the upper flange 21 and the lower flange 22 of the hollow PC module 2, and an end portion of the steel bar 25 is connected to the end portion of the steel bar 25 of the adjacent hollow PC module 2 by the connector 3.

As illustrated in FIG. 28, in the same way as the connection between the steel bars 25 of the neighboring hollow PC modules 2, upper and lower portions of the steel bar 25 of the hollow PC module 2 located at the outermost position are fixed to the second girder 7*b* by the connector 3. In this instance, until the connector 3 is connected, the end portion of the variable assembly PC member 1 can be held on a stepped portion formed on the lower portion of the side surface of the second girder 7*b* in order to support the gravity load of the variable assembly PC member 1.

In order to achieve the above, a fixed steel bar 72 is embedded in the second girder 7*b* to connect the steel bar 25 and the connector 3. The variable assembly PC member 1 can be rigidly connected just by fixation of the connector 3, but preferably, non-shrinkage mortar M is filled between the hollow PC module 2 and the second girder 7*b* so that the hollow PC module 2 and the second girder 7*b* come into close contact with each other in order to prevent vibration of a structure.

In order to reduce vibration of the slab, it is important to transfer negative moment by continuously forming end portions. According to the present invention, the variable assembly PC members 1 for a slab are continued in the longitudinal direction. Moreover, the present invention includes the plurality of hollow PC modules 2 which are divided and can rigidly join the side surface of the hollow PC module 2 to the side surface of the second girder 7*b* by the connector 3. Therefore, the present invention is very effective in reducing vibration.

Like the second girder 7*b*, the first girder 7*a* located at the longitudinal end portion of the hollow PC module 2 has a stepped portion formed on the side surface to hold the end portion of the variable assembly PC member 1. When non-shrinkage mortar M is filled between the variable assembly PC member 1 and the first girder 7*a* in addition to the connection of the connector 3, all four sides of the variable assembly PC member 1 are closely supported and are firmly fixed by rigid connection so as to perfectly control vibration.

Since the connector 3 of the upper portion transfers negative moment of the end portion, if vibration control of the structure is not needed, the connector 3 of the lower portion may be omitted.

Of course, as illustrated in FIGS. 22 and 29, a longitudinal reinforcing bar 213 is exposed in the longitudinal direction of the hollow PC module 2 and is overlapped with a reinforcing bar 71 of the first girder 7*a* so that end portions are continued, thereby resisting the negative moment.

In a case in which the first girder 7*a* is a PC member, the reinforcing bar 71 of the first girder 7*a* is embedded in a rebend steel box, and then, is stretched after completion of installation of the variable assembly PC member 1 so as to be continued with the reinforcing bar 213 of the hollow PC module 2.

In order to expose the longitudinal reinforcing bar 213 of the hollow PC module 2 to the outside, a second stepped portion 212 is formed at an end portion of the upper flange 21.

A second stepped portion 212 can be formed at an end portion of the upper flange 21 so that the end portion of the longitudinal reinforcing bar 213 of the hollow PC module 2 can be exposed to the outside.

The connector 3 includes; a coupler 31 coupled to an end portion of one side steel bar 25; a headed bar 32 of which one end is coupled to the coupler 31 and the other end has an expanded head 321; a socket 33 of which one end is coupled to an end portion of the other side steel bar 25' and the other end has a receiving space 331 for receiving the expanded head 321 of the headed bar 32; and a fixing cap 34 coupled to the receiving space 331 of the socket 33 to press the expanded head 321 of the headed bar 32.

Even in a case in which the variable assembly PC member 1 is a slab, the connector 3 including the coupler 31, the headed bar 32, the socket 33, and the fixing cap 34 may be used for connection between the neighboring hollow PC modules 2 and for joining of the neighboring girders 7*a* and 7*b*.

FIG. 30 is a perspective view illustrating an arrangement of an air injection type balloon mold, and FIG. 31 is a perspective view illustrating a variable assembly PC member for a slab manufactured by the air injection type balloon mold.

As illustrated in FIGS. 30 and 31, an air injection type balloon mold 41 is provided inside the hollow PC module 2.

A slab for semiconductor production equipment should be about 800 mm thick to provide a non-vibration environment, and has a hollow size much larger than a conventional hollow slab. However, a plastic sphere is difficult to form a large hollow hole due to the limitation in rigidity and weight.

Therefore, when the hollow PC module 2 is manufactured, a plurality of air injection type balloon molds 41 are arranged inside a steel mold to be spaced apart from each other as illustrated in FIG. 30, and then, concrete is poured to form a hollow (FIG. 31).

The air injection type balloon mold 41 can reduce the total weight of the PC member since being lighter than the plastic sphere.

In addition, the size of the hollow can be freely adjusted when the amount of air injected into the air injection type balloon mold 41 is adjusted.

In a case in which the variable assembly PC member 1 is installed, the non-shrinkage mortar M should not penetrate into the hollow 20 during grouting.

The conventional hollow PC member cannot remove the plastic sphere. However, in the present invention, after the hollow PC module 2 is completely manufactured, the air injection type balloon mold 41 can be removed and is reusable by deflating the air injection type balloon mold 41.

INDUSTRIAL APPLICABILITY

According to the present invention, the variable assembly PC member is manufactured by using hollow PC modules in each of which a hollow is formed. Therefore, the variable assembly PC member according to the present invention can reduce the burden on carrying and hoisting, is easy to construct on a site, and can facilitate enlargement of members due to reduction of weight of the PC member.

What is claimed is:

1. A variable assembly precast concrete (PC) member comprising:

a plurality of hollow PC modules, each hollow PC module which has an upper flange and a lower flange spaced apart from each other, and a pair of webs connecting both ends of the upper flange and the lower flange to form a hollow therein; and connectors connecting the plurality of hollow PC modules with each other in the width direction, wherein a plurality of steel bars are provided on the upper flange and the lower flange of the hollow PC module in the width direction of the hollow PC module, and the connectors connect the steel bars of the neighboring hollow PC modules with each other, and wherein each connector comprises:

a coupler coupled to an end portion of one side of each steel bar;

a headed bar of which one end is coupled to the coupler and another end has an expanded head;

a socket of which one end is coupled to an end portion of another side of the steel bar and another end has a receiving space for receiving the expanded head of the headed bar; and a fixing cap coupled to the receiving space of the socket to press the expanded head of the headed bar.

2. The variable assembly PC member according to claim 1, wherein a PC steel wire is disposed to penetrate through the upper flanges and the lower flanges of the plurality of hollow PC modules so as to apply post tension.

3. The variable assembly PC member according to claim 2, wherein non-shrinkage mortar is filled between the webs of the neighboring hollow PC modules.

4. The variable assembly PC member according to claim 3, wherein a shim plate is provided around the PC steel wire between the webs of the neighboring hollow PC modules.

5. The variable assembly PC member according to claim 4, wherein magnets are provided on the web around the PC steel wire of one hollow PC module, and the shim plate is attached to the magnets to fix the position.

6. The variable assembly PC member according to claim 4, wherein the shim plate is formed long in the longitudinal direction of the hollow PC module, and a through hole through which the PC steel wire penetrates is formed at the position of the PC steel wire.

7. The variable assembly PC member according to claim 3, wherein a groove portion is formed on the outside of the web of the hollow PC module in the longitudinal direction of the hollow PC module, and a water stop protruding into the groove portion is disposed on the web in the longitudinal direction of the hollow PC module.

8. A variable assembly precast concrete (PC) member which is a PC slab in which cast-in-place concrete is not placed, the variable assembly PC member which is formed by a plurality of hollow PC modules of a rectangular cross section connected in the width direction, each hollow PC module comprising an upper flange, a lower flange, and a pair of webs connecting both ends of the upper flange and the lower flange, and having a hollow formed therein, wherein steel bars are respectively disposed inside the upper flange and the lower flange of the hollow PC module in the width direction of the hollow PC module and an end portion of each steel bar is exposed to a first pocket portion formed at one side end of the upper and lower flanges, and the steel bars of the hollow PC modules abutting in the width direction are connected to each other by a connector inside the first pocket portion, and non-shrinkage mortar is filled between the neighboring hollow PC modules, wherein both end portions of the hollow PC module are joined to a side surface of a first girder disposed at a longitudinal end portion, and wherein the hollow PC module located at an outermost position of the variable assembly PC member is rigidly connected to a fixed steel bar, which is embedded in a second girder disposed at a widthwise end portion of the variable assembly PC member, by the connector.

9. The variable assembly PC member according to claim 8, wherein the connector comprises:

a coupler coupled to an end portion of one side of the steel bar;

a headed bar of which one end is coupled to the coupler and another end has an expanded head;

a socket of which one end is coupled to an end portion of another side of the steel bar and another end has a receiving space for receiving the expanded head of the headed bar; and a fixing cap coupled to the receiving space of the socket to press the expanded head of the headed bar.

* * * * *